US005381774A

United States Patent [19]

Nakajima

[11] Patent Number: 5,381,774

[45] Date of Patent: Jan. 17, 1995

[54] AIR-FUEL RATIO CONTROL SYSTEM FOR INTERNAL COMBUSTION ENGINE

[75] Inventor: Yuki Nakajima, Yokosuka, Japan

[73] Assignee: Nissan Motor Co., Ltd., Yokohama, Japan

[21] Appl. No.: 107,430

[22] Filed: Aug. 16, 1993

[30] Foreign Application Priority Data

Aug. 17, 1992 [JP] Japan ..... 4-217878

[51] Int. Cl.[6] ..... F02D 41/14; F02D 41/32

[52] U.S. Cl. ..... 123/674; 123/679

[58] Field of Search ..... 123/674, 679, 696, 675

[56] References Cited

U.S. PATENT DOCUMENTS

| | | | |
|---|---|---|---|
| 4,603,670 | 8/1986 | Bertsch et al. | 123/679 |
| 4,744,344 | 5/1988 | Morozumi | 123/679 |
| 5,094,214 | 3/1992 | Kotzan | 123/674 |
| 5,158,062 | 10/1992 | Chen | 123/674 |
| 5,163,407 | 11/1992 | Yoshida et al. | 123/674 |
| 5,168,701 | 12/1992 | Yamamoto et al. | 123/674 |
| 5,213,088 | 5/1993 | Harada | 123/674 |

FOREIGN PATENT DOCUMENTS 58-106150 6/1983 Japan .

*Primary Examiner*—Willis R. Wolfe

*Assistant Examiner*—Thomas N. Moulis

*Attorney, Agent, or Firm*—Lowe, Price, LeBlanc & Becker

[57] ABSTRACT

An air-fuel ratio control system for an internal combustion engine equipped with a three-way catalytic converter. The air-fuel ratio control system is basically arranged to feedback-control air-fuel ratio of air-fuel mixture to be supplied to the engine to fall in a stoichiometric range by regulating a basic fuel supply amount in accordance with an air-fuel ratio feedback correction coefficient. The air-fuel ratio feedback correction coefficient is corrected with an integrated amount which is set to be increased after the measured value of a lapsed engine revolution number exceeds a decision standard. The lapsed engine revolution number is stored in the memory, and the average value of the lapsed engine revolution number is renewed with this stored lapsed engine revolution number in the memory. This average value or a value depending upon this average value is set as the decision standard, so that the decision standard is suitably controlled in accordance with situations of the engine thereby precisely obtaining a suitable decision standard regardless of difference in response performance or deteriorated response performance of oxygen sensors.

7 Claims, 20 Drawing Sheets

AIR-FUEL RATIO CONTROL SYSTEM FOR INTERNAL COMBUSTION ENGINE

BACKGROUND OF THE INVENTION

1. Field of the Invention

This invention relates to improvements in an air-fuel ratio control system for an internal combustion engine of an automotive vehicle or the like, arranged to accomplish a feedback control of the air-fuel ratio of an air-fuel mixture to be supplied to the engine in accordance with a detection signal representative of the air-fuel (oxygen-combustibles) ratio in exhaust gas from the engine.

2. Description of the Prior Art

Most automotive vehicles are equipped with a so-called three-way catalytic converter for simultaneously converting harmful three components CO, HC (hydrocarbons), NOx (nitrogen oxides) in exhaust gas from an internal combustion engine. In such automotive vehicles, the air-fuel ratio of an air-fuel mixture is feedback-controlled to be fall into a narrow range including stoichiometric value as a center, in response to an air-fuel (oxygen-combustibles) ratio in exhaust gas which ratio is detected by an oxygen sensor located in an exhaust pipe. The three-way catalytic converter effectively works only within the narrow range of the air-fuel ratio of the mixture to be supplied to the engine.

In the feedback-control, an actual fuel supply amount to the engine is determined by correcting a basic fuel supply amount depending upon some engine operating parameters, mainly with a so-called air-fuel ratio feedback correction coefficient (amount) $\alpha$. The air-fuel ratio feedback correction coefficient is renewed upon being corrected with a so-called step amount and a so-called integrated amount. Immediately after the air-fuel ratio is inverted from its lean side to its rich side, the step amount is applied to the air-fuel ratio feedback control coefficient in order to return the air-fuel ratio to the lean side at a high response, and thereafter the integrated amount of a smaller value is applied to the air-fuel ratio feedback control coefficient until the air-fuel ratio is inverted to the rich side, thus stabilizing the feedback control. When the air-fuel ratio is inverted from the rich side to the lean side, a control is made in a reverse manner relative to the above.

Even under the above feedback control, the air-fuel ratio of the air-fuel mixture to be supplied to the engine unavoidably largely shifts from the lean to the rich side or vice versa in the event that the air-fuel ratio is disturbed by acceleration, deceleration and outside disturbances such as fuel purge from a carbon canister, gear shift and EGR (exhaust gas recirculation). If the thus largely shifted air-fuel ratio is intended to be corrected by the integrated amount which is set corresponding to a steady state (engine operating conditions other than the acceleration, deceleration and the outside disturbances), the correction control with the integrated amount follows or continues for long. Accordingly, in the even that the air-fuel ratio largely shifts to the rich side, HC and CO are unavoidably emitted from the catalytic converter in the course of returning the air-fuel ratio to the lean side. On the contrary, in the event that the air-fuel ratio is shifts largely to the lean side, NOx is unavoidably emitted in the course of returning of the air-fuel ratio to the rich side.

In order to solve the above problems, a proposition has been made as disclosed in Japanese Patent Provisional Publication No. 58-106150, which is arranged as follows: A so-called lapsed engine revolution number is measured since the air-fuel ratio is inverted from the lean side to rich side or vice versa. The thus measured lapsed engine revolution number is compared with a decision standard. When the measured lapsed engine revolution number exceeds the decision standard, the value of the integrated amount is increased. As shown in FIG. 23, a smaller integrated amount I1 is applied for a while from a time immediately after the inversion of the air-fuel ratio. However, if the air-fuel ratio is not inverted even after a while and the lapsed engine revolution number is brought into agreement with the decision standard, an integrated amount 12 having a large inclination is applied from that time point. Thus, the value of the integrated amount is increased in the course of an air-fuel ratio feedback control cycle, thereby following the air-fuel ratio largely shifted to the rich side or the lean side at a high response.

However, drawbacks have been encountered even in the above proposition, as set forth below. In the above proposition, the decision standard C1 for changing the magnitude of the integrated amount has been previously set, in which, for example, the value of the integrated amount is increased if a predetermined time has lapsed from the time at which application of the integrated amount is initiated. Accordingly, there arises a problem that correction by the integrated amount becomes excessive or deficient, owing to difference among engines, difference in response performance among oxygen sensors, or deterioration in response performance of the oxygen sensor with age.

This will be discussed more specifically with reference to FIG. 24 which shows the change in control frequency of an oxygen sensor in terms of a distance traveled by an automotive vehicle. As shown in FIG. 24, the control frequency at the time of initiation in use is about 2.0 to 2.5 Hz when the oxygen sensor is new, and it lowers as the vehicle travel distance increases. The control frequency lowers to the lowest value of about 1.4 Hz. Additionally, it is observed that the distribution of the control frequency relative to the average value is enlarged as the vehicle traveled distance increases.

If the control frequency of the oxygen sensor thus changes, the control cycle of the air-fuel ratio feedback correction coefficient $\alpha$ is changed. This is because the control cycle of the air-fuel ratio feedback correction coefficient $\alpha$ depends on the output of the oxygen sensor. Thus, when the reaction of the oxygen sensor is retarded under a deteriorated response performance, the control cycle of the air-fuel ratio feedback correction coefficient $\alpha$ is prolonged. Additionally, the control cycle of the same coefficient is changed in accordance with difference in response performance among oxygen sensors.

Assume that the decision standard C1 is determined so as to increase the integrated amount when the lapsed engine revolution number becomes 3 from the time of the inversion of the air-fuel ratio between its lean and rich sides, so that the decision standard is in agreement with a new oxygen sensor. In this case, if the control frequency of the air-fuel ratio feedback correction coefficient $\alpha$ is prolonged owing to deteriorated response performance of the oxygen sensor, the timing of increasing the integrated amount is advanced thereby excessively increasing the amount of feedback correction.

SUMMARY OF THE INVENTION

It is an object of the present invention to provide an improved air-fuel ratio control system for an internal combustion engine, which can overcome the drawbacks encountered in similar conventional control systems.

Another object of the present invention is to provide an improved air-fuel ratio control system for an internal combustion engine, which can provide an optimum decision standard for increasing an integrated amount regardless of change in control frequency of an air-fuel ratio feedback correction amount which change is owing to difference among engines and to deteriorated performance of the control system.

A further object of the present invention is to provide an improved air-fuel ratio control system for an internal combustion engine, which employs an average value of a lapsed parameter (for example, a lapsed engine revolution number or lapsed time) required between adjacent inversions of air-fuel ratio from its lean to rich sides or vice versa, as a standard for increasing the integrated amount.

As shown in FIG. 1, an air-fuel ratio control system of the present invention is for an internal combustion engine and comprises an oxygen sensor 31 (12) disposed in an exhaust gas passageway of the engine. First decision means 32 is provided to decide whether an air-fuel ratio of air-fuel mixture supplied to the engine is in a rich side or a lean side relative to a stoichiometric value. Second decision means 33 is provided to decide whether the air-fuel ratio makes its first inversion from the rich side to the lean side or its second inversion from the lean side to the rich side upon taking account of a decision result of the first decision means. Lapsed parameter measuring means 34 is provided to measure a lapsed parameter which has been lapsed between the adjacent first and second inversions of the air-fuel ratio in accordance with decision results of said first and second decision means. Comparing means 35 is provided to compare a measured value of the lapsed parameter with a decision standard. Integrated amount increasing means 36 is provided to increase an integrated amount after the lapsed parameter measured value exceeds the decision standard, relative to that during a time in which the measured value is smaller than the decision standard. A feedback correction amount calculation means 37 is provided to calculate an air-fuel ratio feedback correction amount in accordance with the integrated amount. Fuel control effecting means 38 is provided to effect a control of fuel to be supplied to the engine in accordance with the air-fuel ratio feedback correction amount. A memory 39 is provided to memorize the lapsed parameter required between the adjacent inversions of the air-fuel ratio. Average value renewing means 40 is provided to renew an average value of the lapsed parameter in accordance with the value of lapsed parameter in the memory. Additionally, decision standard setting means 41 is provided to set a value relating to the average value as the decision standard.

Thus, the present invention resides in improvements in the air-fuel ratio control system which is basically arranged such that the air-fuel ratio feedback correction amount is corrected with the integrated amount which is set to be increased after the measured value of the lapsed parameter exceeds the decision standard. According to the improvements, the lapsed parameter is stored in the memory, and the average value of the lapsed parameter is renewed with this stored lapsed parameter in the memory. This average value or a value depending upon this average value is set as the decision standard. Thus, the decision standard is suitably controlled in accordance with situations of the engine, thereby precisely obtaining a suitable decision standard regardless of difference in response performance or deteriorated response performance of oxygen sensors. This effectively improves exhaust emission of the engine while providing no problem against difference among engines and deteriorated performance of the air-fuel ratio control system.

More specifically, assume that a feedback control of the air-fuel ratio is carried out when a new oxygen sensor having a high control frequency is used in a steady state engine operating condition other than engine acceleration and deceleration and engine operations in which an outside disturbance is applied. In this situation, the average value (of the lapsed parameter required between the adjacent inversions of the air-fuel ratio) corresponds to the lapsed parameter required between the adjacent inversions of the air-fuel ratio in the steady state engine operating condition. If the air-fuel ratio largely shifts to the rich or lean side owing to the outside disturbance such as a gear shift and gas purge of a carbon canister, or the acceleration or deceleration during the feedback of the air-fuel ratio, the integrated amount having a small value is unavoidably applied for long. In this regard, when the measured value of the lapsed parameter since the air-fuel ratio inversion exceeds the above average value, the value of the integrated amount is increased thereby fastening the follow-up of the air-fuel ratio feedback correction amount.

In the event that the oxygen sensor makes its deteriorated response performance, the response of the oxygen sensor is retarded different from that of the new oxygen sensor, so that the control cycle of the air-fuel ratio feedback correction amount depending upon output of the oxygen sensor is prolonged. This changes the lapsed parameter required between the adjacent inversions of the air-fuel ratio. The thus changed lapsed parameter is fetched to the memory, so that the above average value is renewed to become larger in case that the lapsed parameter required between the adjacent inversions of the air-fuel ratio upon deterioration of response performance of the oxygen sensor is increased relative to that of the new oxygen sensor; and the average value is renewed to become smaller in case that the lapsed parameter is decreased relative to that of the new oxygen sensor. The thus renewed average value represents the lapsed parameter required between the adjacent inversions of the air-fuel ratio from the lean to rich sides or vice versa, under a condition that the response performance of the oxygen sensor has been deteriorated.

In this case, when engine operation is at the transient time or the outside disturbances are applied, the measured value of the lapsed parameter exceeds the average value. The average value changes according to the present response performance or condition of the oxygen sensor, so that an appropriate decision can be made as to whether a large change in air-fuel ratio is made due to the outside disturbances or the like even after the oxygen sensor makes its response performance deterioration, by using the average value as the decision standard.

In case that the control frequencies of the oxygen sensors widely scatter through the upper limit value to the lower limit value, the oxygen sensors having the upper and lower limit values take respectively different values of the lapsed parameter required between the adjacent inversions of the air-fuel ratio from the lean to rich sides or vice versa. Thus, by using the average value, an appropriate decision can be made as to whether a large air-fuel ratio change due to the outside disturbances or the like is made or not, even in case that the oxygen sensor has the upper or lower limit control frequency value.

Thus, by virtue of using as the decision standard the average value of the lapsed parameter required between the adjacent inversions of the air-fuel ratio, the decision standard changes in accordance with the present status of each oxygen sensor and in accordance with the degree of the deteriorated response performance if the oxygen sensor makes its deterioration in response performance. Accordingly, it is possible to make the decision as to whether the air-fuel ratio large change due to the outer disturbances or the like is made, even in case that there is difference among oxygen sensors and a deterioration in performances in the control system.

BRIEF DESCRIPTION OF THE DRAWINGS

In the drawings, like reference numerals and characters represent like elements and matters throughout all figures, in which.

DETAILED DESCRIPTION OF THE INVENTION

Figure 1:
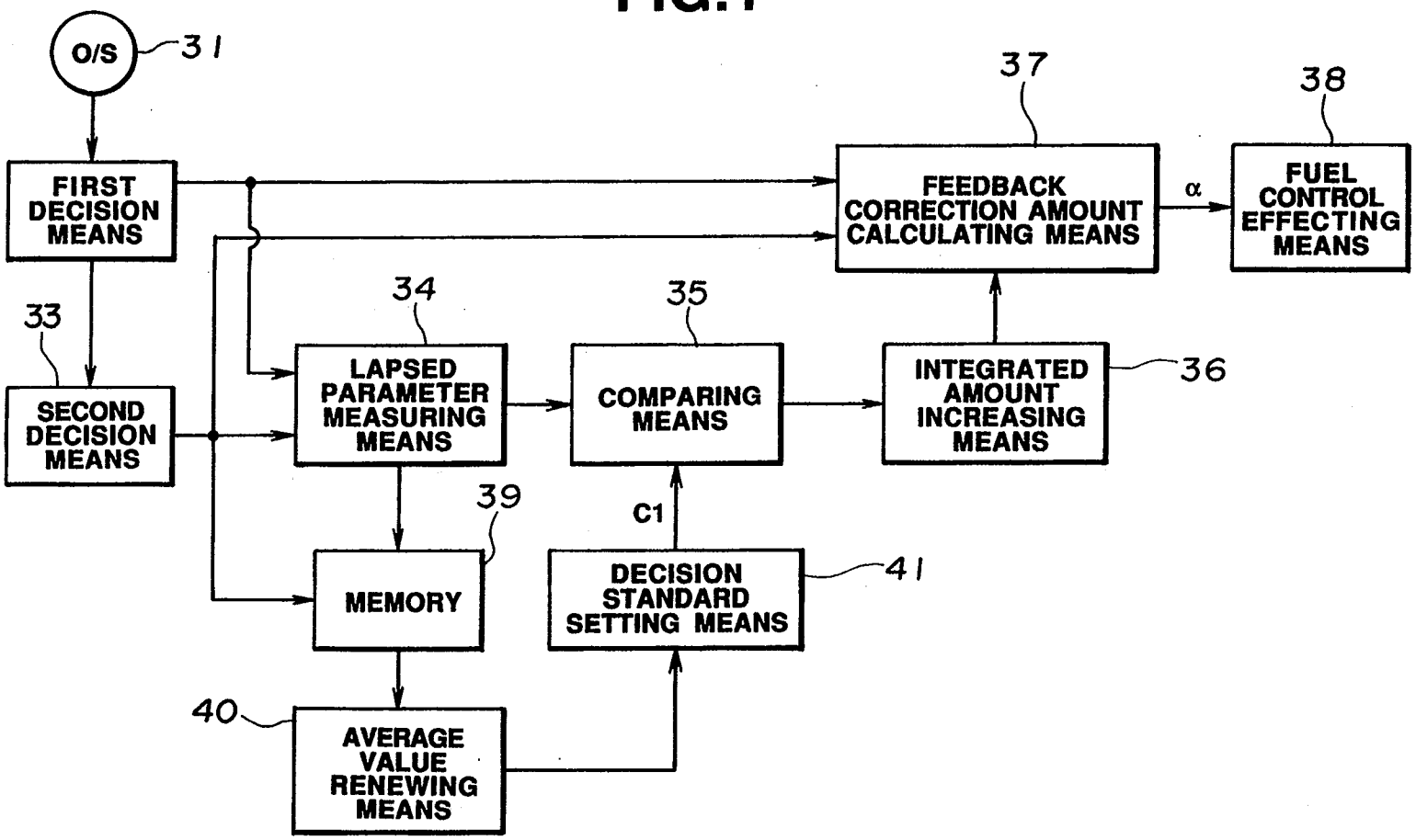
FIG. 1 is a block diagram illustrating the principle of an air-fuel ratio control system of the present invention.
Figure 2:
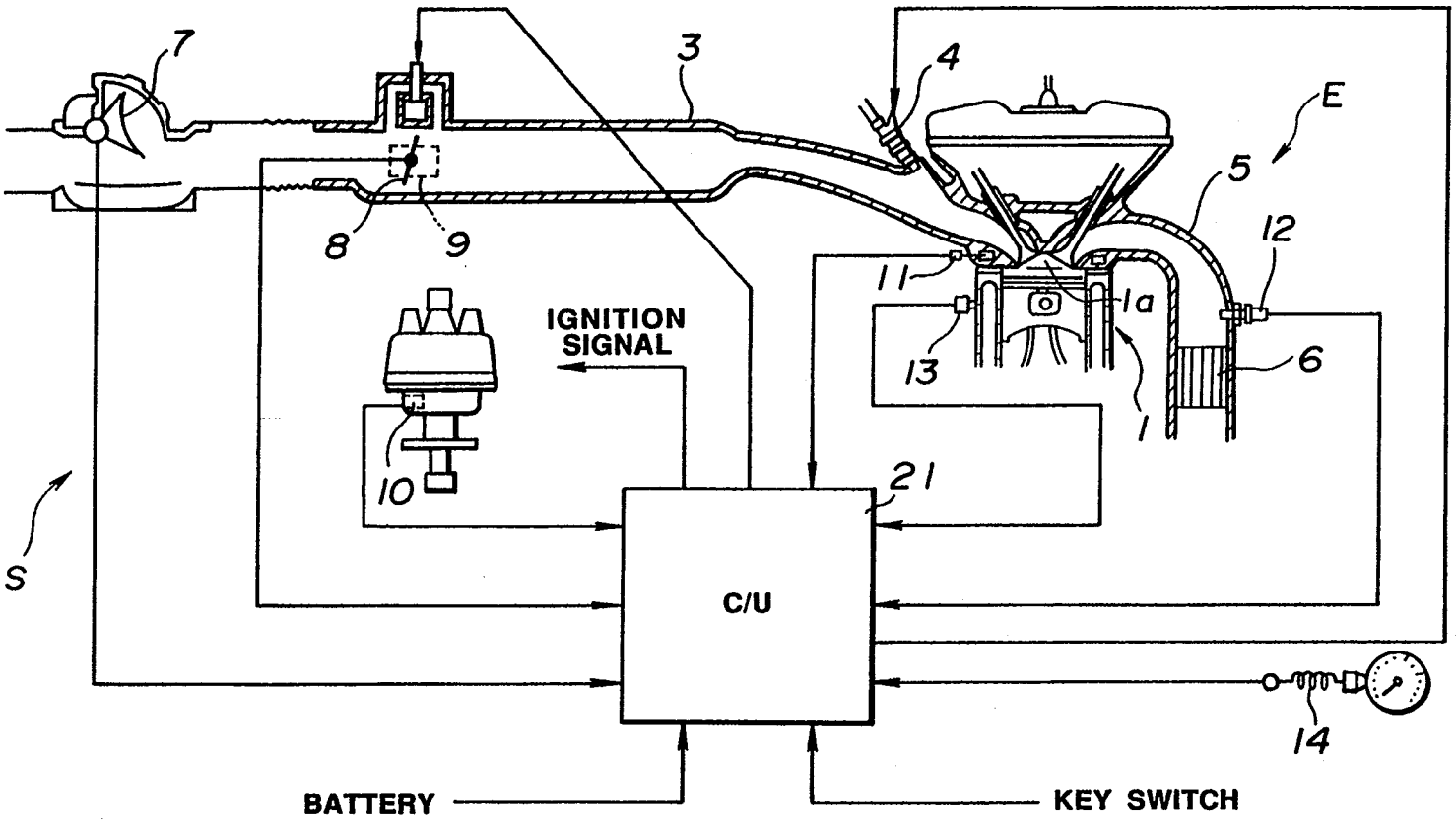
FIG. 2 is a schematic illustration of a first embodiment of the air-fuel ratio control system in accordance with the present invention.

Referring now to FIG. 2 of the drawings, a first embodiment of an air-fuel ratio control system according to the present invention is illustrated by the reference character S and incorporated with an internal combustion engine E of an automotive vehicle (not shown). The engine E includes an engine body 1 having combustion chambers la one of which is shown. The engine body 1 is provided with an intake air passageway 3 through which intake air is supplied to the combustion chambers la. An exhaust gas passageway 5 is provided to be communicable with the combustion chambers 1*a* so that exhaust gas from the combustion chambers 1*a* is discharged through the exhaust gas passageway 5 to the atmospheric air. An airflow meter 7 is disposed in the intake air passageway 3 to detect the amount Qa of air inducted through an air filter (not shown). An idle switch 9 is disposed in the intake air passageway 3 to be switched ON under an idling condition of the engine.

A crankangle sensor 10 is provided to output a first signal every a unit crankangle and a second signal every a standard crankangle. An engine coolant temperature sensor 11 is provided to output a signal representative of an engine coolant temperature. An oxygen sensor 12 is disposed in the exhaust gas passageway 5 to output a signal representative of air-fuel (oxygen-combustibles) ratio in exhaust gas passing through the exhaust gas passageway 5, in which the value of the signal corresponds to oxygen concentration in exhaust gas and largely changes at stoichiometric air-fuel ratio of air-fuel mixture to be supplied to the combustion chambers 1*a* of the engine body 1. A knock sensor 13 is installed to the engine body 1 to detect engine knock. Additionally, a vehicle speed sensor 14 is provided to detect a traveling speed of the automotive vehicle. These sensors and the likes are electrically connected with a control unit 21 so that the signals outputted from them are input to the control unit 21.

A fuel injector 4 is disposed projecting into the intake air passageway 3 and located near the combustion chambers 1*a*. The fuel injector 4 is electrically connected with the control unit 21 so that the amount (referred to as "fuel injection amount") of fuel injected from the fuel injector 4 is controlled by the control unit 21. The control unit 21 functions to control a fuel injection time for which fuel is injected from the fuel injector 4, in which the fuel injection amount increases as the fuel injection time is prolonged whereas it decreases as the fuel injection time is shortened. The air-fuel ratio (or the concentration of fuel) is shifted to a so-called rich side if the fuel injection amount is enlarged relative to a certain amount of intake air, whereas it is shifted to a so-called lean side if the fuel injection amount is minimized relative to the certain amount of intake air.

Accordingly, by determining a basic value (referred to as a "basic fuel injection amount") of the fuel injection amount in such a way that the ratio between it and the intake air amount becomes constant, air-fuel mixture having the same air-fuel ratio can be supplied to the engine even if engine operating conditions are different. In case that one fuel injection from the fuel injector 4 is made per one engine revolution, the basic fuel injection amount Tp (per one engine revolution) relative to the intake air amount inducted per one engine revolution is determined from an induction air amount Qa (the amount of air inducted into the engine) and an engine speed N (engine revolution number per unit time), in which $Tp = K.Qa/Ne$ where K is a constant. The air-fuel ratio (determined by the basic fuel injection amount Tp) of the air-fuel mixture to be supplied to the engine is usually near the stoichiometric value under a feedback control. If the air-fuel ratio shifts from a range near the stoichiometric value, the basic fuel injection amount Tp is corrected with an air-fuel ratio feedback correction coefficient $\alpha$ thereby to again converge the air-fuel ratio to the stoichiometric range.

A three-way catalytic converter 6 is disposed in the exhaust gas passageway 5 to simultaneously convert harmful three gas components CO, HC, NOx in exhaust gas into harmless gas components. Such conversion of the three-way catalytic converter 6 is accomplished only when the air-fuel ratio of the air-fuel mixture to be supplied to the engine is within a narrow range around the stoichiometric value. If the air-fuel ratio shifts even slightly to the rich side from the narrow range, emission of CO and HC increases. On the contrary, if the air-fuel ratio shifts even slightly to the lean side from the narrow range, emission of NOx increases. In view of the above, in order to cause the three-way catalytic converter to effectively function, the control unit 21 controls the air-fuel ratio to fall within the narrow stoichiometric range by making a feedback correction of the air-fuel ratio in response to the signal representative of the air-fuel ratio, from the oxygen sensor 12. If the output of the oxygen sensor is higher than a slice level corresponding to the stoichiometric air-fuel ratio, the air-fuel ratio resides in the rich side. If the same output is lower than the slice level, the air-fuel ratio resides in the lean side.

When the air-fuel ratio is detected as being inverted from the lean side to the rich side as detected as a result of the above, the air-fuel ratio must be returned to the lean side. Accordingly, as shown in a flowchart of FIG. 3 which illustrates a processing for calculating the air-fuel ratio feedback correction coefficient $\alpha$, a step amount PR is subtracted from the air-fuel ratio feedback correction coefficient $\alpha$ immediately after the air-fuel ratio is inverted to the rich side, and an integrated amount I is subtracted from the air-fuel ratio feedback correction coefficient $\alpha$ until a time immediately before the air-fuel ratio is inverted to the lean side as indicated at steps S2, S3, S6; and steps S2, S3, S12 in FIG. 3. On the contrary, when the air-fuel ratio is inverted from the rich side to the lean side, a step amount PL is added to the air-fuel ratio feedback correction coefficient $\alpha$, whereas an integrated amount I is added to the air-fuel ratio feedback correction coefficient $\alpha$ until a time immediately before the air-fuel ratio is inverted to the rich side as indicated at steps S2, S4, S14; and steps S2, S4, S20 in FIG. 3. The calculation of the air-fuel ratio feedback correction coefficient $\alpha$ is executed in timed relation to engine revolution. This is because this calculation is brought into timed relation to fuel injection by the fuel injector 4 and to disturbances in the control system, in which the fuel injection from the fuel injector 4 and the disturbances are in timed relation to the engine revolution. In the flowchart, "F/B" at the step S1 indicates a feedback control under information from the oxygen sensor 12, and "RICH" at the step S2 indicates that the air-fuel ratio detected under the action of the oxygen sensor 12 resides in the rich side. A "prior time" in steps 3 and 4 represents an immediately preceding air-fuel ratio feedback control cycle.

The value of the above-mentioned step amounts PR, PL is considerably large relative to the value of the integrated amount I. The large step amount PR is applied stepwise immediately after the air-fuel ratio is inverted to the rich side thereby changing the air-fuel ratio to the lean side at a high response, and the large step amount PL is applied stepwise immediately after the air-fuel ratio is inverted to the lean side thereby changing the air-fuel ratio to the rich side at a high response. After making such a stepwise change, the air-fuel ratio is slowly changed from the lean side to the rich side or vice versa with the integrated amount I of a smaller value, thus stabilizing an air-fuel ratio feedback control.

The step amounts PR, PL are determined by looking up in maps (not shown) whose parameters are the basic fuel injection amount (=basic pulse width) Tp and engine speed Ne, as indicated at steps S5 and S13. The basic pulse width is a pulse width (of the signal applied from the control unit 21 to the fuel injector 4) causing the basic fuel injection amount, and corresponds to an engine load of the engine.

Thus, when the air-fuel mixture to be supplied to the engine is leaner than a stoichiometric air-fuel mixture, the fuel injection amount is increased to obtain the stoichiometric air-fuel ratio. On the contrary, when the air-fuel mixture is richer than the stoichiometric air-fuel mixture, the fuel injection amount is decreased to obtain the stoichiometric air-fuel ratio. Such controls are repeated to converge the air-fuel ratio of the air-fuel mixture into the stoichiometric value.

Even during the air-fuel ratio feedback control, there arise a large shift of the air-fuel ratio to the rich or lean side owing to acceleration and deceleration and outside disturbances such as a gear shift, a fuel purge from a carbon canister (not shown) to the air intake passage, and the like. The carbon canister is constructed and arranged to temporarily store fuel vapor in an intake system of the engine for the purpose of emission control in the intake system. When such a large shift of the air-fuel ratio arises, the value of the integrated amount is changed in accordance with the measured value of a lapsed engine revolution number since the inversion of the air-fuel ratio from the lean side to the rich side or vice versa, for the purpose of hastening the follow-up of the air-fuel ratio feedback correction coefficient $\alpha$.

Figure 3:
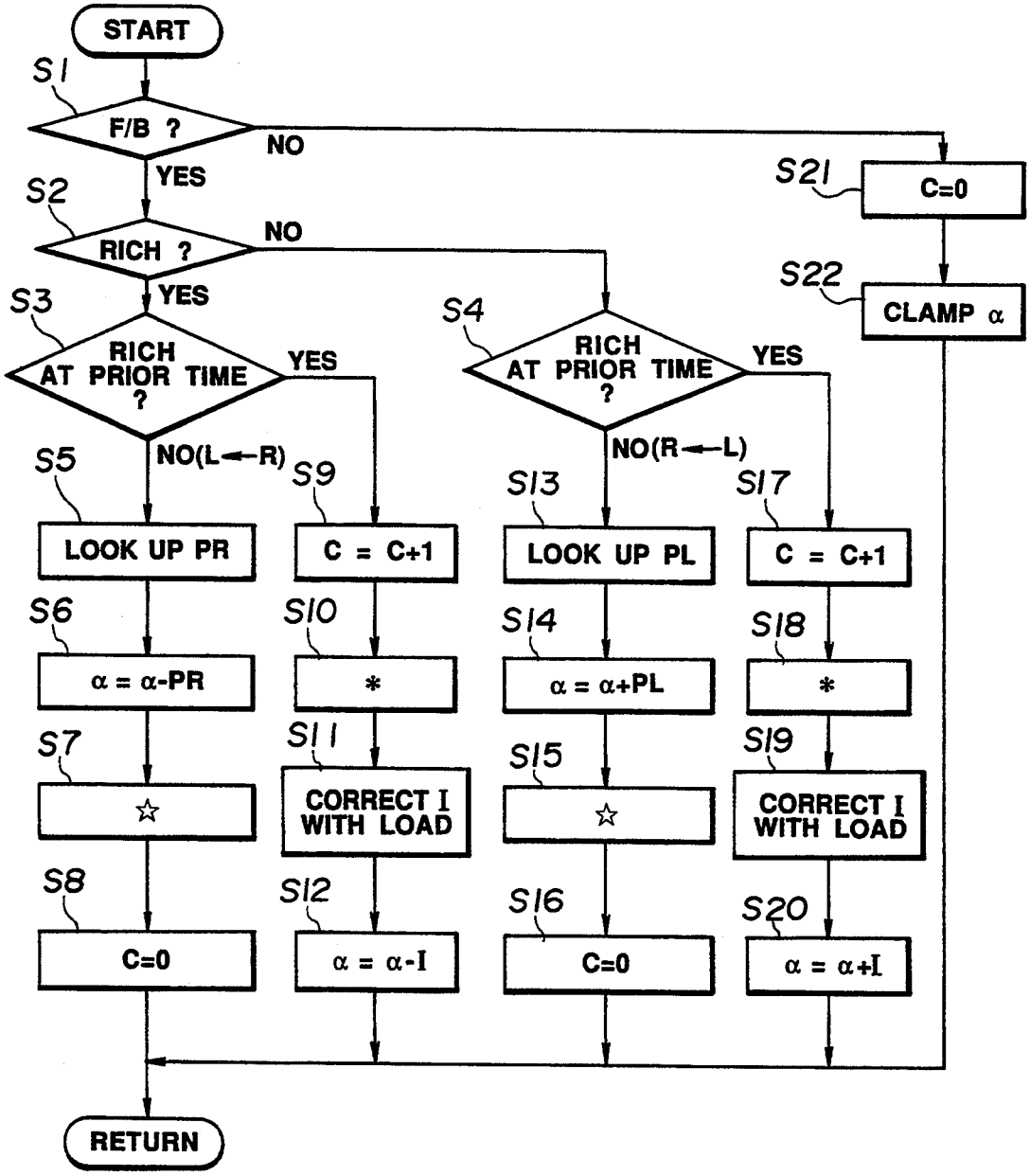
FIG. 3 is a flowchart illustrating the calculation of an air-fuel ratio feedback coefficient to be used in control of the first embodiment air-fuel ratio control system.

Measurement of the lapsed engine revolution number since the inversion of the air-fuel ratio between the lean and rich sides is carried out as follows: As shown in FIG. 3, when the air-fuel ratio is inverted from the rich side to the lean side, a counted value C is cleared to establish C=0 at a step S16, and a count-up is made to make an increment one by one since a time immediately after the inversion of the air-fuel ratio in timed relation to engine revolution at a step S17 during continuation in value of the air-fuel ratio in the lean side, in which the counted value C represents the lapsed engine revolution number since the inversion of the air-fuel ratio. When the air-fuel ratio is inverted from the lean side to the rich side, the counted value C is cleared to establish C=0 at a step S8, and a count-up is made to make an increment one by one since a time immediately after the inversion of the air-fuel ratio at a step S9 during continuation in value of the air-fuel mixture in the rich side.

Figure 4:
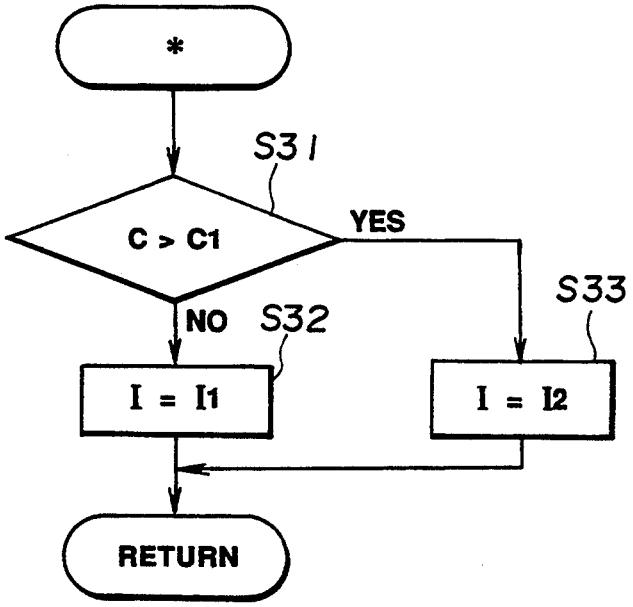
FIG. 4 is a flowchart illustrating the manner of obtaining an integrated amount under look-up, to be used in the control of the first embodiment air-fuel ratio control system.

Looking-up of the integrated amount I is carried out by comparing the above-mentioned counted value C with a decision standard C1 as shown in FIG. 4. More specifically, in case of $C \leqq C1$, an integrated amount I1 of a smaller value is applied at steps S31 and S32. In case of $C > C1$, an integrated amount I2 larger than the integrated value I1 is applied in order to raise the follow-up response performance at steps S31 and S33. These integrated amounts I1, I2 are obtained by being looked up in a map whose parameters are the basic fuel injection amount (=basic pulse width) Tp and engine speed Ne. The thus obtained map values of the integrated amounts are further corrected with engine load as indicated at steps S11 and S19. This correction is made to render the amplitude of the air-fuel ratio feedback correction coefficient approximately constant regardless of the control cycle of the air-fuel ratio feedback correction coefficient $\alpha$ since there is the possibility that the amplitude of the air-fuel ratio feedback correction coefficient increases in an engine operating region in which the control cycle of the air-fuel ratio feedback correction coefficient $\alpha$ is prolonged thereby to deteriorate the conversion efficiency of the three-way catalytic converter.

Now, assuming that the above-mentioned decision standard C1 is constant, there will be the possibility that the air-fuel ratio feedback control cannot meet the change of the air-fuel ratio correction coefficient $\alpha$ due to difference in response performance among oxygen sensors 12 and to a deteriorated response performance of the oxygen sensor 12, thereby causing an excessive feedback correction upon increasing the integrated amount or a deficient feedback correction.

In order to deal with the above, the following control is made: The lapsed engine revolution number required between adjacent inversions of the air-fuel ratio is memorized in a memory of the control unit 21. The value of moving average of the lapsed engine revolution number required between the adjacent inversions is renewed by using the value of the lapsed engine revolution number in the memory. This moving average value is used as the above-mentioned decision standard C1.

Figure 5:
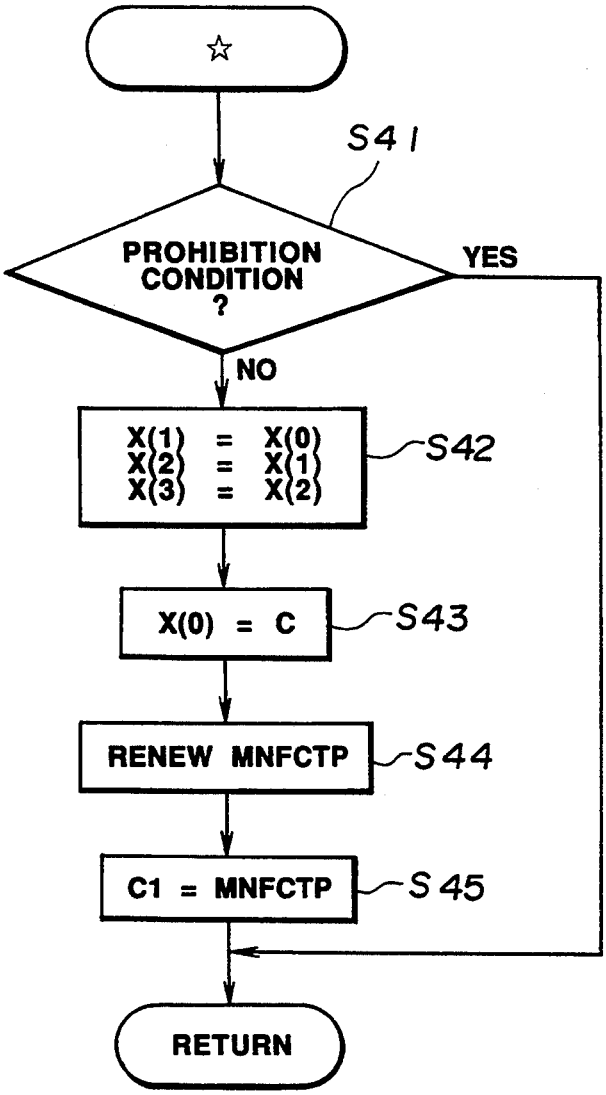
FIG. 5 is a flowchart illustrating a moving average MNFCTP to be used in the operation of the first embodiment air-fuel ratio control system.

When the counted value C is moved to a memory X(0) at a time at which the air-fuel ratio is inverted from the lean side to the rich side or vice versa as indicated at steps S2, S3, S7 in FIG. 3 and a step S43 in FIG. 5; or at steps S2, S4, S15 in FIG. 3 and a step S43 in FIG. 5, the final value (or the lapsed engine revolution number required between the adjacent inversions of the air-fuel ratio) in the counted values is stored every a half cycle of the air-fuel ratio feedback correction coefficient $\alpha$.

Memorization of several times (for example, four times) is made on the lapsed engine revolution number required between the adjacent inversions of the air-fuel ratio upon going back to the past. Accordingly, an arrangement of memories X(1) has been prepared, in which the value of X(0) is shifted to X(1), the value of X(1) to X(2), and the value of X(2) to X(3) in a succeeding manner before the newest value is fetched, as shown at a step 42 in FIG. 5. By this, the newest value and the values (of the lapsed engine revolution number required between the adjacent inversions of the air-fuel ratio) obtained successively upon going back to the past are stored in the four memories X(0) to X(3).

By using the values of these memories, a value MNFCTP of moving average is renewed according to the following equation as indicated at a step 44 in FIG. 5:

$$MNFCTP=(X(0)+X(1)+X(2)+X(3))/4 \qquad \text{Eq. 1}$$

The newest value of the moving average value MNFCTP is fetched to X(0) per a half cycle of the air-fuel ratio feedback correction coefficient $\alpha$, and the oldest value in X(3) is discarded, so that the moving average value MNFCTP represents the average of four lapsed engine revolution numbers (each required between the adjacent inversions of the air-fuel ratio) in the past. The renewed result or moving average value is applied as the decision standard C1 as indicated at a step 45 in FIG. 5. This moving average value MNFCTP applied as the decision standard C1 is read out when the integrated amount is applied and compared with the counted value C as indicated at step 31 in FIG. 4.

The reason why the moving average value MNFCTP is applied as the decision standard C1 is that the moving average value represents the lapsed engine revolution number under a steady state (except for an engine operation transient time and conditions in which the outside disturbances are applied) in which change in air-fuel ratio is stable and under a present response permance status of the oxygen sensor. For example, in case that the control frequency is high during the steady state because the oxygen sensor is new, the moving average value MNFCTP increases as the control frequency of the oxygen sensor 12 is lowered due to the deteriorated response performance.

A weighted mean may be used in place of the moving average. In this case, it is sufficient that the value in the memory is the newest value, and the value is renewed according to the following equation:

$$MNFCTP=(1-Y)\cdot MNFCTP+Y\cdot X(0) \quad \text{Eq. 2}$$

where Y is a weighted average coefficient.

In practice, it is preferable to use the value of MNFCTP2 depending upon the moving average value MNFCTP, as the decision standard C1. The MNFCTP2 value is calculated according to the following equations:

$$MNFCTP2=MNFCTP\cdot R \quad \text{Eq. 3}$$

$$MNFCTP2=MNFCTP+S \quad \text{Eq. 4}$$

$$MNFCTP2=MNFCTP+\sigma \quad \text{Eq. 5}$$

where R is a predetermined value, S is a predetermined value, and $\sigma$ is a standard deviation.

The integrated amount is enlarged (a) when the counted value C becomes a value of R times (not less than 1 time) the moving average value as represented by Eq. 3, (b) when the counted value C becomes a value obtained by adding the predetermined value S to the moving average value as represented by Eq. 4, or (c) when the counted value C becomes a value obtained by adding the standard deviation $\sigma$ to the moving average value as represented by Eq. 5, thus providing a room in air-fuel ratio feedback control.

The above-mentioned standard deviation is given by the following equation:

$$\sigma=\sqrt{\frac{\Sigma X(k)^2-\frac{1}{n}(\Sigma X(k))^2}{n-1}}$$

Since the lapsed engine revolution number required between the adjacent inversions of the air-fuel ratio slightly increases and decreases even in the steady state, and therefore there is the possibility that the relationship of C>C1 is established thereby increasing the value of the integrated amount even in the steady state. However, increasing the value of the integrated amount is for the purpose of raising the response performance of the air-fuel ratio feedback correction coefficient $\alpha$ to meet the transient times of engine operation and the outside disturbances. Accordingly, if the value of the integrated amount is increased in the steady state, an unnecessary feedback control is made so that the wave form of the air-fuel ratio feedback correction coefficient $\alpha$ becomes to an oscillated condition. In view of this, even when the counted value C corresponding to the lapsed engine revolution number since the inversion of the air-fuel ratio comes to the moving average value MNFCTP, the value of the integrated amount is not immediately increased. That is, the value of the integrated amount is increased upon standing by for a while by virtue of MNFCTP2 when the air-fuel ratio comes to the moving average MNFCTP.

The manner of operation of this embodiment will be discussed.

When the feedback control of the air-fuel ratio is made in the steady state under a condition a new oxygen sensor having a high control frequency is used, the value of the moving average MNFCTP at this time corresponds to the lapsed engine revolution number MNFCTP required between the adjacent inversions of the air-fuel ratio in the steady state. In the event that the air-fuel ratio largely shifts to the rich or lean side owing to the outside disturbances such as a gear shift and a gas purge of the carbon canister, and acceleration and deceleration, the integrated amount having a smaller value is necessarily applied for a long time, and therefore the value of the integrated amount is increased to hasten the follow-up of the air-fuel ratio feedback correction coefficient $\alpha$ when the counted value C (corresponding to the lapsed engine revolution number since the inversion of the air-fuel ratio) exceeds the value of the moving average MNFCTP.

In the event that the oxygen sensor makes its deteriorated response performance, the response of the oxygen sensor is retarded different from that of the new oxygen sensor, so that the control cycle of the air-fuel ratio feedback correction coefficient $\alpha$ depending upon output of the oxygen sensor is prolonged. This changes the lapsed engine revolution number required between the adjacent inversions of the air-fuel ratio. The thus changed lapsed engine revolution number is fetched to the memory X(i), so that the value of the moving average MNFCTP is renewed to become larger in case that the lapsed engine revolution number required between the adjacent inversions of the air-fuel ratio upon deterioration of response performance of the oxygen sensor is increased relative to that of the new oxygen sensor; and the moving average MNFCTP is renewed to become smaller in case that the lapsed engine is decreased relative to that of the new oxygen sensor. The thus renewed value of the moving average MNFCTP represents the lapsed engine revolution number required between the adjacent inversions of the air-fuel ratio from the lean to rich sides or vice versa, under a condition that the response performance of the oxygen sensor has been deteriorated.

In this case, when engine operation is at the transient time or the outside disturbances are applied, the counted value C exceeds the value of the moving average MNFCTP. The value of the moving average MNFCTP changes according to the present response performance or condition of the oxygen sensor, so that an appropriate decision can be made as to whether a large change in air-fuel ratio is made due to the outside disturbances or the like even after the oxygen sensor makes its response performance deterioration, by using the moving average MNFCTP as the decision standard C1.

In case that the control frequencies of the oxygen sensors widely scatter through the upper limit value to the lower limit value, the oxygen sensors having the upper and lower limit values take respectively different values of the moving average MNFCTP, and therefore take respectively the different lapsed engine revolution numbers each required between the adjacent inversions of the air-fuel ratio from the lean to rich sides or vice versa. Thus, by using the moving average MNFCTP, an appropriate decision can be made as to whether a large air-fuel ratio change due to the outside disturbances or the like is made or not, even in case that the oxygen sensor has the upper or lower limit control frequency value.

Figure 6:
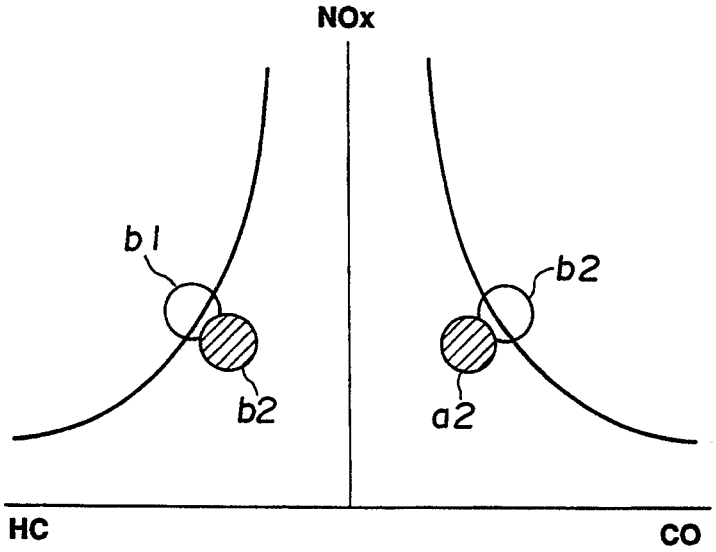
FIG. 6 is a graph showing an exhaust emission improvement effect of the first embodiment air-fuel ratio control system.

Thus, by virtue of using as the decision standard C1 the value of the moving average MNFCTP of the lapsed engine revolution number required between the adjacent inversions of the air-fuel ratio, the decision standard C1 changes in accordance with the present status of each oxygen sensor, and changes in accordance with the degree of the deteriorated response performance if the oxygen sensor makes its deterioration in response performance. Accordingly, it is possible to make the decision as to whether the air-fuel ratio large change owing to the outer disturbances or the like is made, even in case that there is difference among oxygen sensors and a deterioration in performances in the control system, as long as such difference and deterioration are appeared as change in control frequency of the air-fuel ratio feedback correction coefficient $\alpha$. It will be understood that such a decision never be made by the prior art as disclosed in Japanese Patent Provisional Publication No. 58-106150, even under the same situations. In this regard, FIG. 6 shows a comparison in exhaust emission (concentration in exhaust gas) of HC, CO and NOx between this embodiment of the present invention and a control system of the prior art disclosed in Japanese Patent Provisional Publication No. 58-106150, in which hatched circles a1, a2 indicate the exhaust emission of the control system of the present invention whereas clear circles b1, b2 indicate that of the control system the prior art. FIG. 6 demonstrates that the exhaust emission of the control system of the present invention is improved over that of the control system of the prior art.

Additionally, by using as the decision standard C1 the value of the MNFCTP2 depending upon the moving average, the value of the integrated amount is increased after lapse of time for a while even if the lapsed engine revolution speed from the time of the inversion of the air-fuel ratio is brought into agreement with the value of the moving average MNFCTP, thereby preventing the integrated amount value to be increased regardless of the steady state.

Now, assume that the lapsed engine revolution number required between the adjacent inversions of the air-fuel ratio is stored in the memory X(i), and the value of the moving average MNFCTP is renewed with the stored value in the memory even when the air-fuel ratio largely changes owing to the outside disturbances or under a low coolant temperature condition in which the output of the oxygen sensor is unstable. In such a situation, the value of the moving average is increased than that in the steady state thereby unnecessarily retarding a timing at which the value of the integrated amount is increased.

This will be discussed more specifically with reference to three experimental examples.

Figure 7:
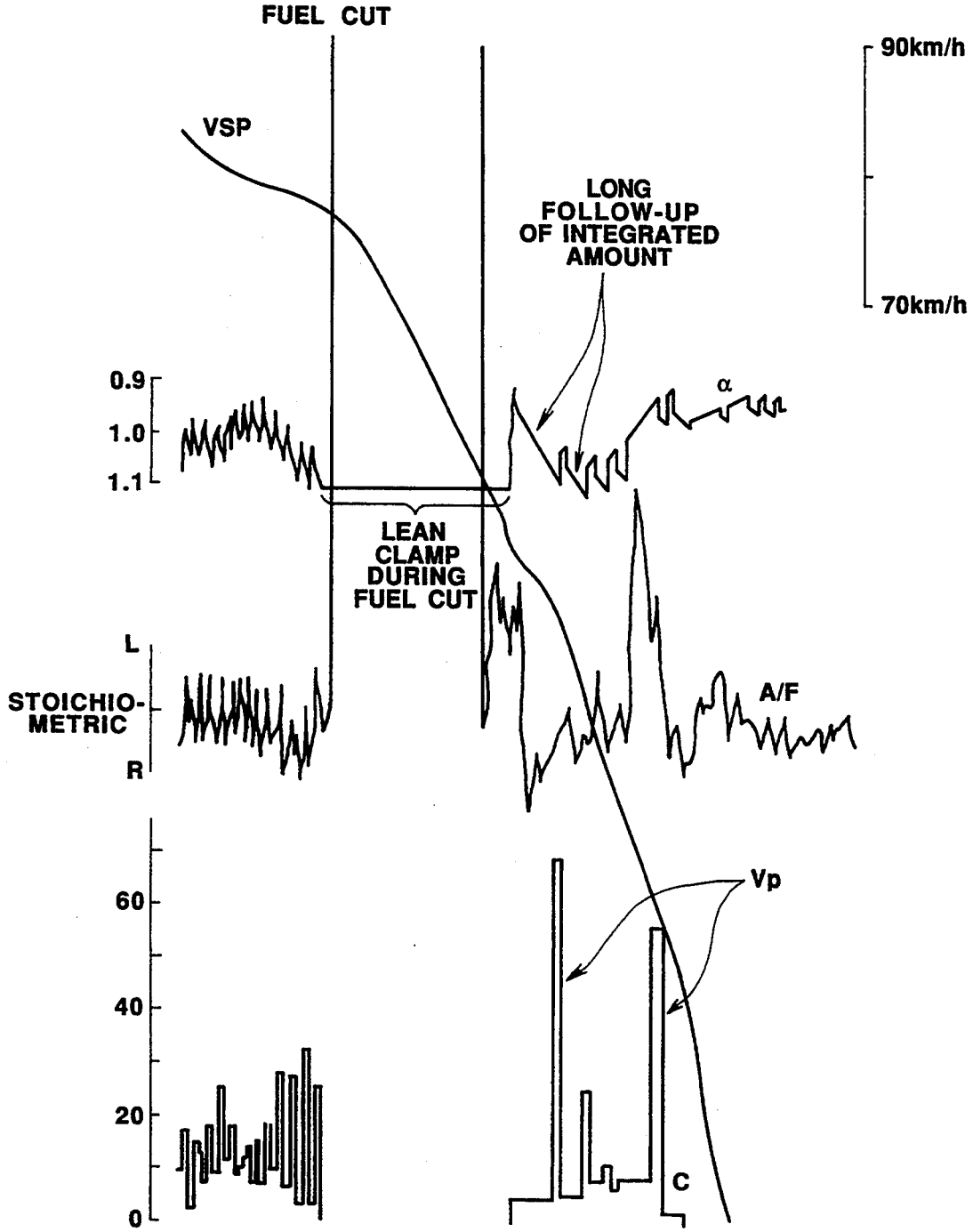
FIG. 7 is a graph showing change in a variety of engine and vehicle operating parameters during an engine deceleration.

FIG. 7 shows a first experimental example during an engine deceleration from a high vehicle speed operating condition, indicating changing wave forms of the air-fuel ratio (A/F), the air-fuel ratio feedback correction coefficient ($\alpha$), the counted value (C) and a vehicle speed (VSP). As shown in FIG. 7, immediately after a lean clamp (the air-fuel ratio is fixed at a value in the lean side) during a fuel cut (interrupting fuel supply), the air-fuel ratio shifts to the rich side because liquid fuel flowing along the inner wall surface of the intake ports is separated from the inner wall surface and flows into the engine cylinders. The integrated amount for returning the rich side air-fuel ratio to the lean side is unavoidably applied for long as indicated as a follow-up of the integrated amount in FIG. 7. This causes peak values Vp to appear in the counted value C as shown in FIG. 7.

Figure 8:
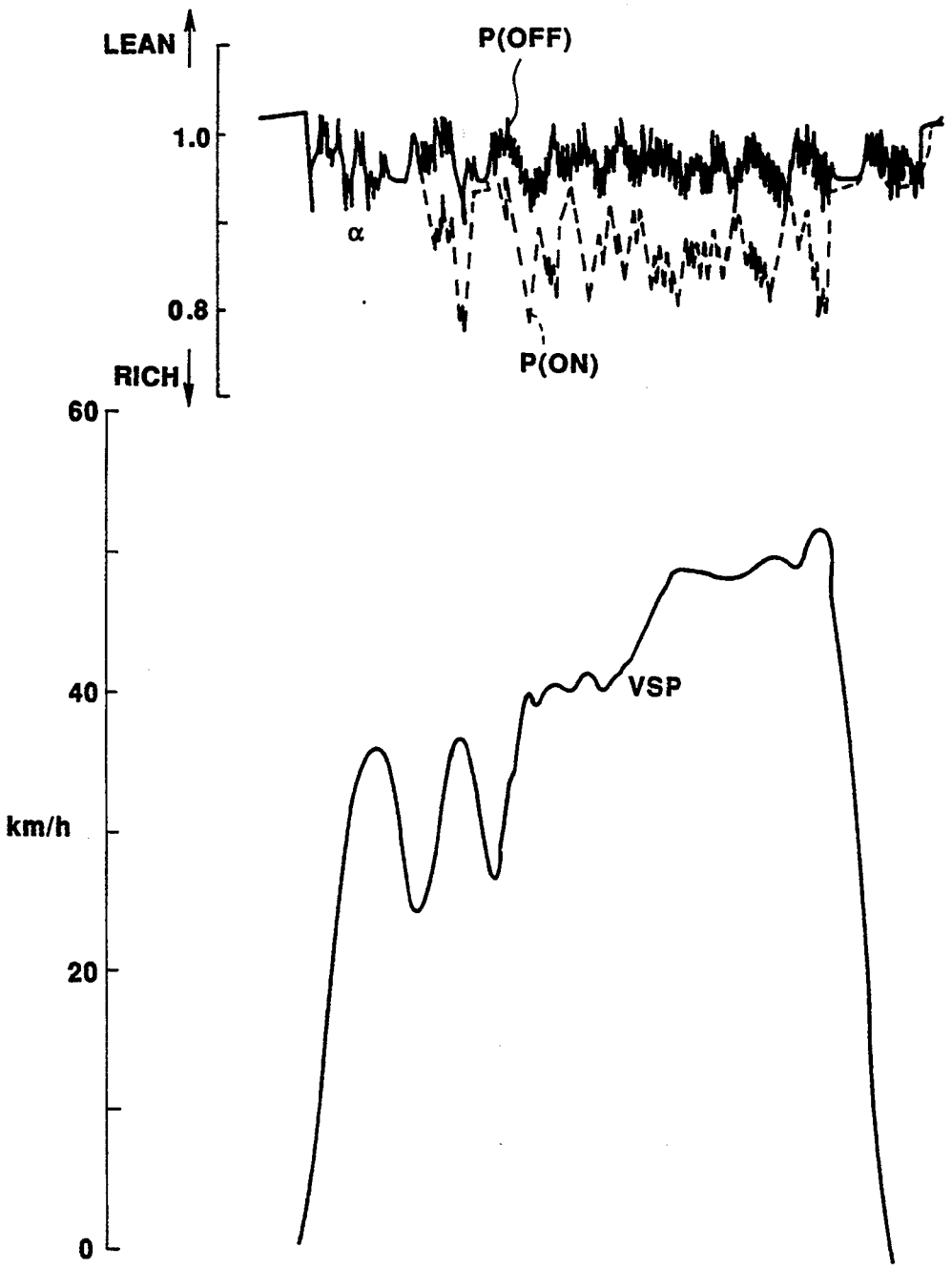
FIG. 8 is a graph showing change in a variety of engine and vehicle operating parameters during a gas purge of a carbon canister and during stopping of the gas purge.

FIG. 8 shows a second experimental example during gas purge of the carbon canister being switched ON in which fuel vapor stored in the carbon canister is purged and sucked into the engine cylinders, indicating changing wave forms of the air-fuel ratio feedback correction coefficient ($\alpha$) and the vehicle speed (VSP). In FIG. 8, a line P(ON) indicates the air-fuel ratio feedback correction coefficient $\alpha$ during the gas purge of the carbon canister is switched ON, whereas a line P(OFF) indicates the air-fuel ratio feedback correction coefficient $\alpha$ during the gas purge of the carbon canister is switched OFF in which fuel vapor stored in the carbon canister is not purged. FIG. 8 demonstrates that there arises a large disturbance in the air-fuel ratio during the gas purge switched ON, and therefore a follow-up by the integrated amount continues for long thereby enlarging the lapsed engine revolution number required between the adjacent inversions of the air-fuel ratio from the lean to rich sides or vice versa.

Figure 9:
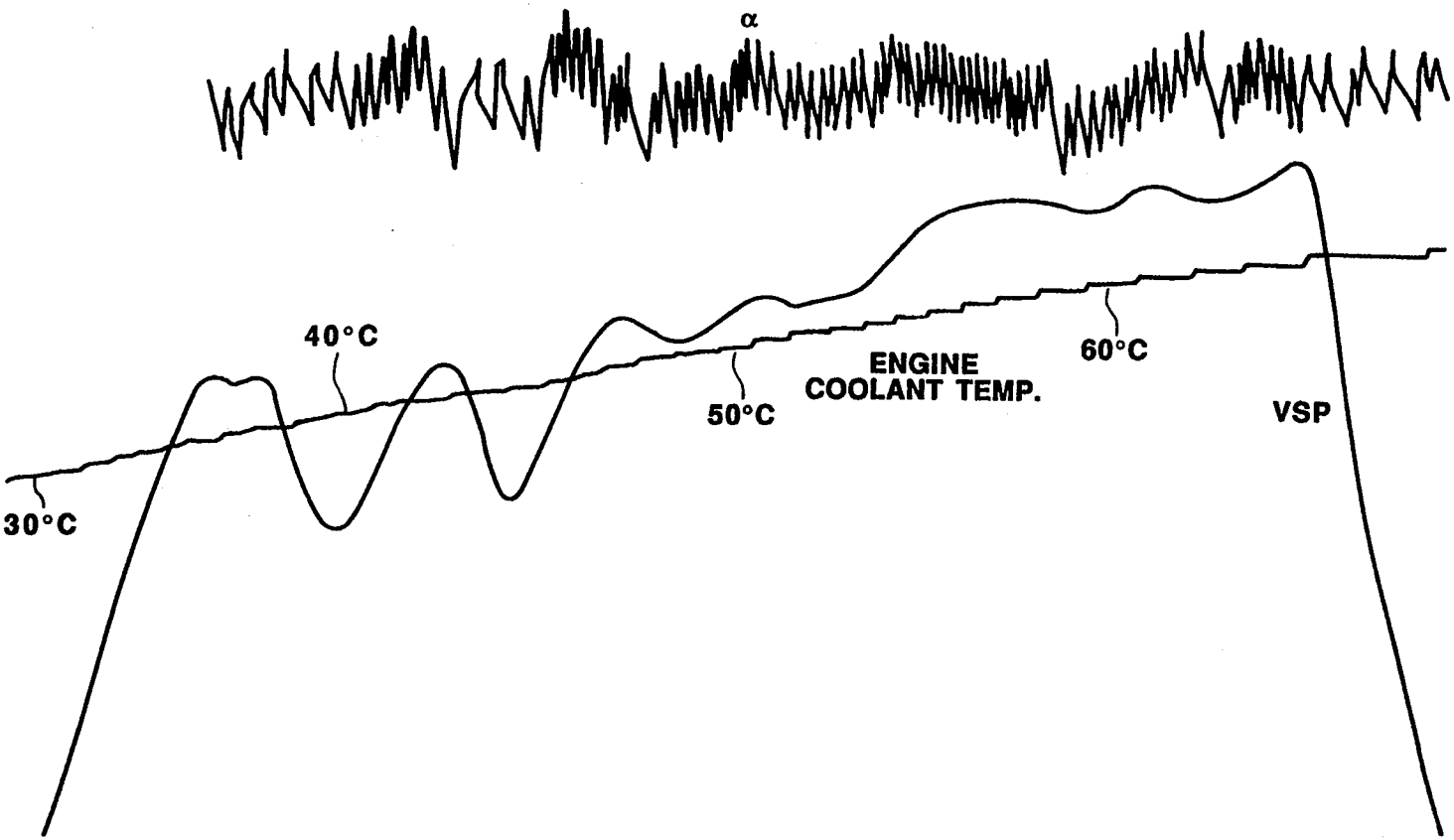
FIG. 9 is a graph showing change in a variety of engine and vehicle operating parameters during a low engine coolant temperature operation.
Figure 10:
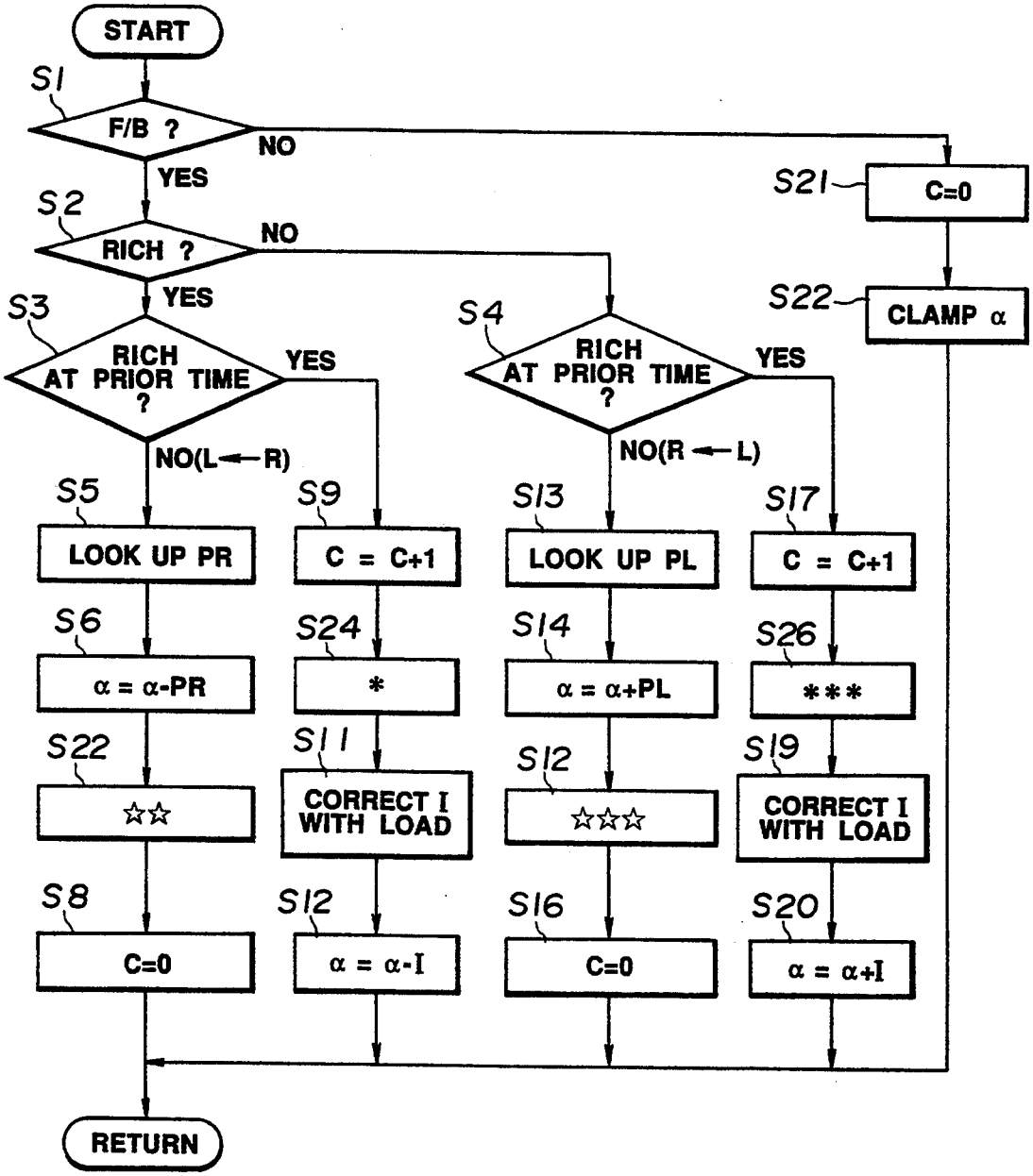
FIG. 10 is a flowchart similar to that of FIG. 3 but showing the calculation of the air-fuel ratio feedback correction coefficient to be used in the operation of a second embodiment of the air-fuel ratio control system in accordance with the present invention.
Figure 11:
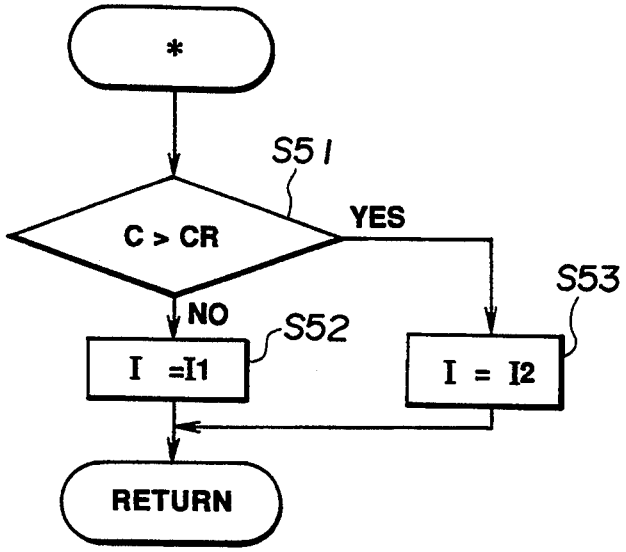
FIG. 11 is a flowchart illustrating the manner of obtaining an integrated amount in a rich side under look-up, to be used in the control of the second embodiment air-fuel ratio control system.
Figure 12:
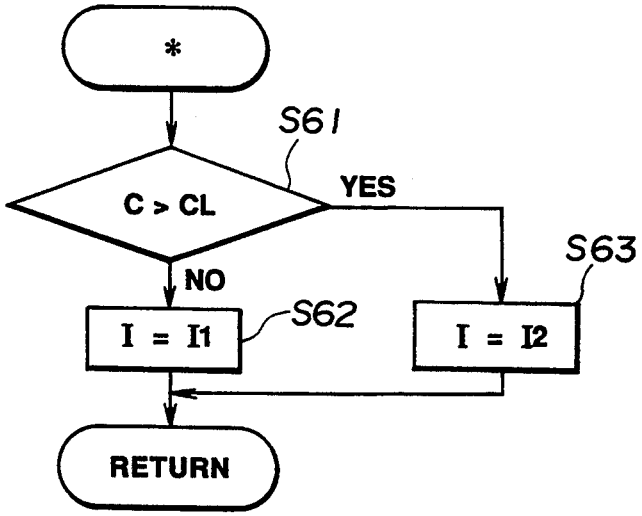
FIG. 12 is a flowchart illustrating the manner of obtaining another integrated amount in a lean side under look-up, to be used in the control of the second embodiment air-fuel ratio control system.

FIG. 9 shows a third experimental example during a low coolant temperature engine operation or engine starting, indicating changing wave forms of the air-fuel ratio feedback correction coefficient ($\alpha$), the engine coolant temperature, and the vehicle speed (VSP). During the low coolant temperature engine operation, much fuel is adhered on the wall surface of the intake ports since the temperature of the wall surface of the intake ports is low. Accordingly, the response performance of fuel supply to the engine cylinders is degraded as compared with that during a high engine coolant temperature engine operation. Consequently, a follow-up by the integrated amount unavoidably continues for long thereby enlarging the lapsed engine revolution number required between the adjacent inversions of the air-fuel ratio.

Thus, during the engine deceleration, the carbon canister gas purge switched ON, and the low engine coolant temperature operating condition, the lapsed engine revolution number required between the air-fuel ratio inversions is enlarged as compared with that during the steady state engine operation, the carbon canister gas purge switched OFF, and the high engine coolant temperature operation. The thus enlarged value of the lapsed engine revolution number is fetched to the memory X(i) thereby to renew the value of the moving average MNFCTP. This enlarges the moving average value so as to retard the timing of enlarging the value of the integrated amount.

The moving average itself functions to suppress the effect of peak values, and therefore the value of the moving average MNFCTP does not change largely when the peak value momentarily disappears. However, although the moving average MNFCTP is a kind of average value, it unavoidably gradually increases when the condition in which the carbon canister gas purge is switched ON continues for long or when a high engine coolant temperature operation continues for long.

In view of the above, in this embodiment, the following three conditions are set as prohibition conditions:

(1) During the engine deceleration;

(2) During the gas purge of the carbon canister being switched ON; and/or (2) During the low engine coolant temperature operation (for example, TW<TWSTP where TW is an engine coolant temperature; and TWSTP is a predetermined engine coolant temperature).

As shown in FIG. 5, a determination is made as to whether a present engine operation meets one of the above three prohibition conditions (1), (2) and (3) as indicated at a step S41. If it meets the prohibition condition, storing of the lapsed engine revolution number in the memory X(i) and moving the number are not made while interrupting the renewing the value of the moving average MNFCTP, skipping over steps S42 to S45 in FIG. 5.

It will be understood that it is sufficient to make sampling of the lapsed engine revolution number required between the air-fuel ratio inversion only during the steady state operation, because the moving average MNFCTP is inherently used to distinguish the steady state operation from other engine operations in which the outside disturbances are applied. It will be appreciated that the above arrangement of this embodiment prevents the timing of enlarging the integrated amount from being unnecessarily retarded during the engine deceleration, the carbon canister gas purge switched ON and/or the low engine coolant temperature operation.

FIGS. 10 to 14 illustrates a second embodiment of the air-fuel ratio control system according to the present invention, similar to the first embodiment with the exception that the lapsed engine revolution numbers (required between the air-fuel ratio inversions) in the rich and lean sides are respectively stored in separate memories. In this embodiment, the lapsed engine revolution number in the lean side is stored in memories XL(0) to XL(3) as indicated at steps S72, S73 in FIG. 13, whereas it in the rich side is stored in memories XR(0) to XR(3) as indicated at steps S82, S83 in FIG. 14. The moving average MNFCTL in the lean side and the moving average MNFCTR in the rich side are respectively calculated according to the following equations and renewed as indicated at a step S74 in FIG. 13, and as indicated at a step S84 in FIG. 14:

$$MNFCTL=(XL(0)+XL(1)+XL(2)+XL(3))/4 \quad \text{Eq. 6}$$

$$MNFCTR=(XR(0)+XR(1)+XR(2)+XR(3))/4 \quad \text{Eq. 7}$$

Figure 13:
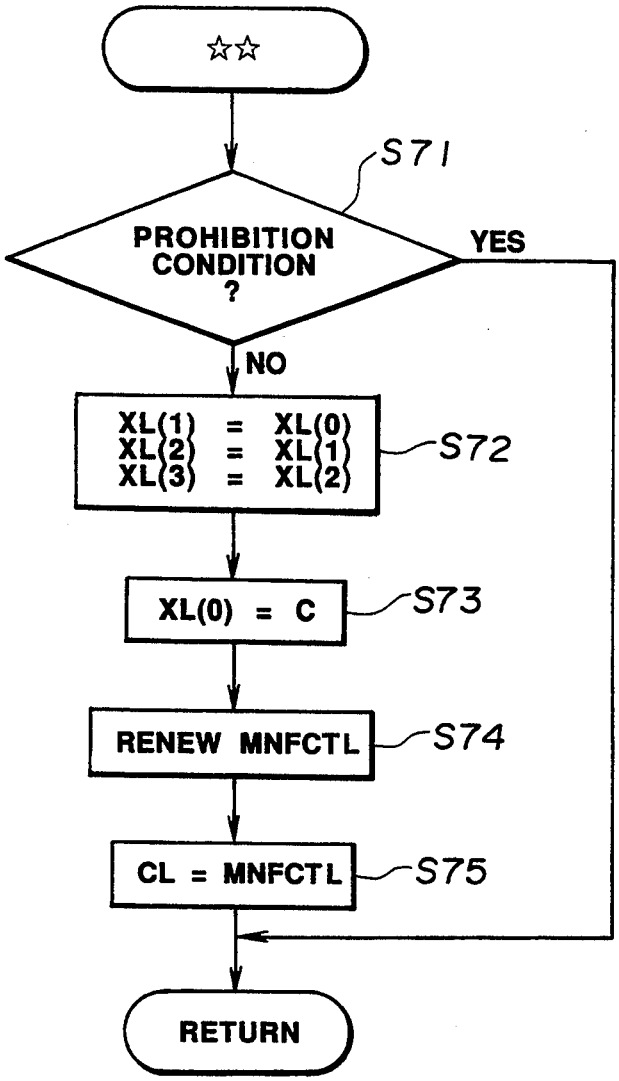
FIG. 13 is a flowchart illustrating the calculation of-a moving average MNFCTL in the lean side, to be used in the control of the second embodiment air-fuel ratio control system.
Figure 14:
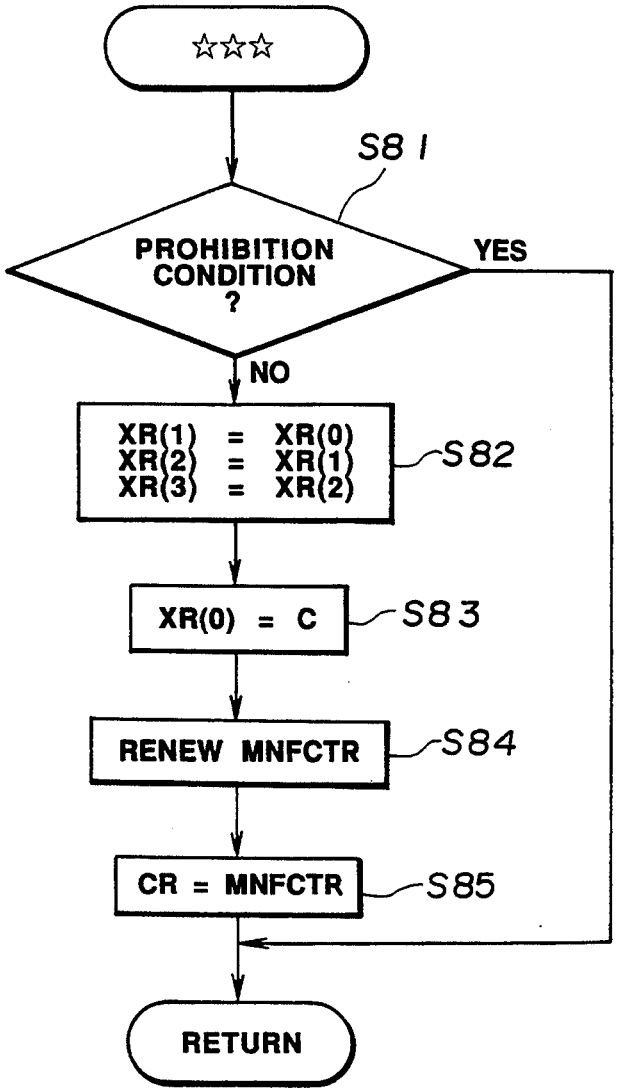
FIG. 14 is a flowchart illustrating the calculation of another moving average MNFCTLR in the rich side, to be used in the control of the second embodiment air-fuel ratio control system.
Figure 15:
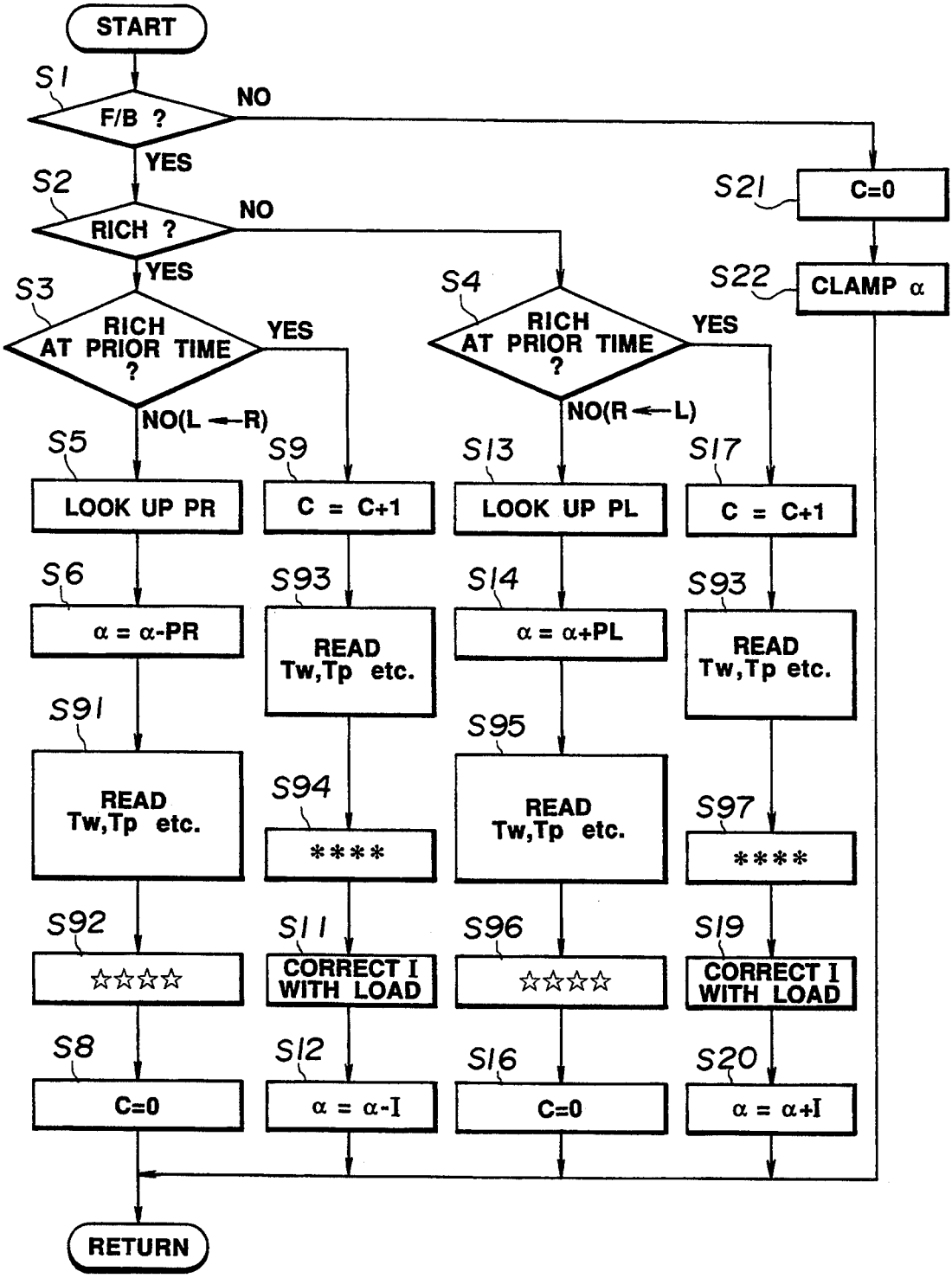
FIG. 15 is a flowchart similar to that of FIG. 3 but showing the calculation of the air-fuel ratio feedback correction coefficient to be used in the operation of a third embodiment of the air-fuel ratio control system in accordance with the present invention.

The thus renewed moving averages are applied as the separate decision standards (CL in the lean side, and CR in the rich side) as indicated respectively at a step S75 in FIG. 13 and at a step S85 in FIG. 15. When the integrated amount is applied in the lean side, the decision standard CL in the lean side is used as indicated at steps S2, S4, S26 in FIG. 10 and at a step S61 in FIG. 12. When the integrated amount is applied in the rich side, the decision standard CR is used as indicated at steps S2, S3, S24 in FIG. 10 and a step S51 in FIG. 11.

The above-discussed arrangement of the second embodiment will be effective for the following cases:

(1) A case in which the step amounts PR, PL are set to have different values, taking account of balance in response in a fuel supply system of the engine or of requirements from view points of exhaust emission and the three-way catalytic converter. In this case, the lapsed engine revolution numbers respectively in the rich and lean sides are largely different such that, for example, it becomes larger in the rich side than that in the lean side in the event of PL>PR. Accordingly, it is required to distinguish the decision standards (for enlarging the integrated amount I) at the respective rich and lean sides from each other, preferably using the second embodiment.

(2) Another case in which another oxygen sensor is disposed at a position (relatively low in exhaust gas temperature) downstream of a catalyst of the three-way catalytic converter (6) in addition to the oxygen sensor (12) located upstream of the catalyst. This is called a dual oxygen sensor system and intended to correct the magnitude of the step amount by using the information from the downstream side oxygen sensor. The oxygen sensor (12) is subjected to high temperature exhaust gas and therefore tends to cause its deteriorated response performance. In this case, a large difference is made between the lapsed engine revolution numbers (each required between the inversions of the air-fuel ratio) respectively in the rich and lean sides owing to unbalance between the step amounts PR, PL. Accordingly, it is required to distinguish the decision standards (for enlarging the integrated amount I) at the respective rich and lean sides from each other, preferably using the second embodiment.

As discussed above, according to the second embodiment of the present invention, the decision standard for enlarging the value of the integrated amount can be precisely applied even in the case that the step amounts PR, PL are set respectively at difference values, or even in the case that the step amounts PR, PL become respectively the different values in the dual oxygen sensor system.

Figure 16:
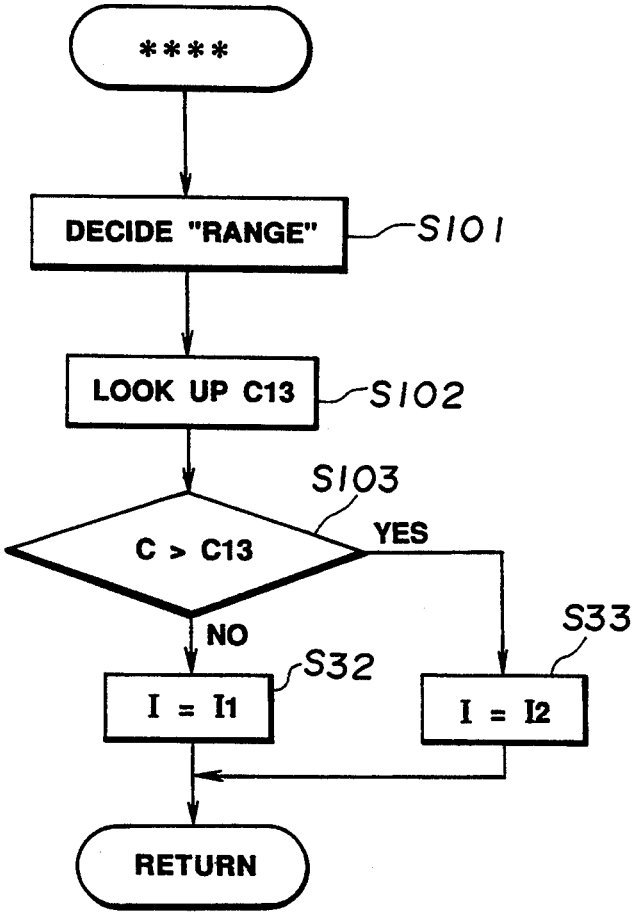
FIG. 16 is a flowchart illustrating the manner of obtaining an integrated amount under look-up, to be used in the control of the third embodiment air-fuel ratio control system.
Figure 17:
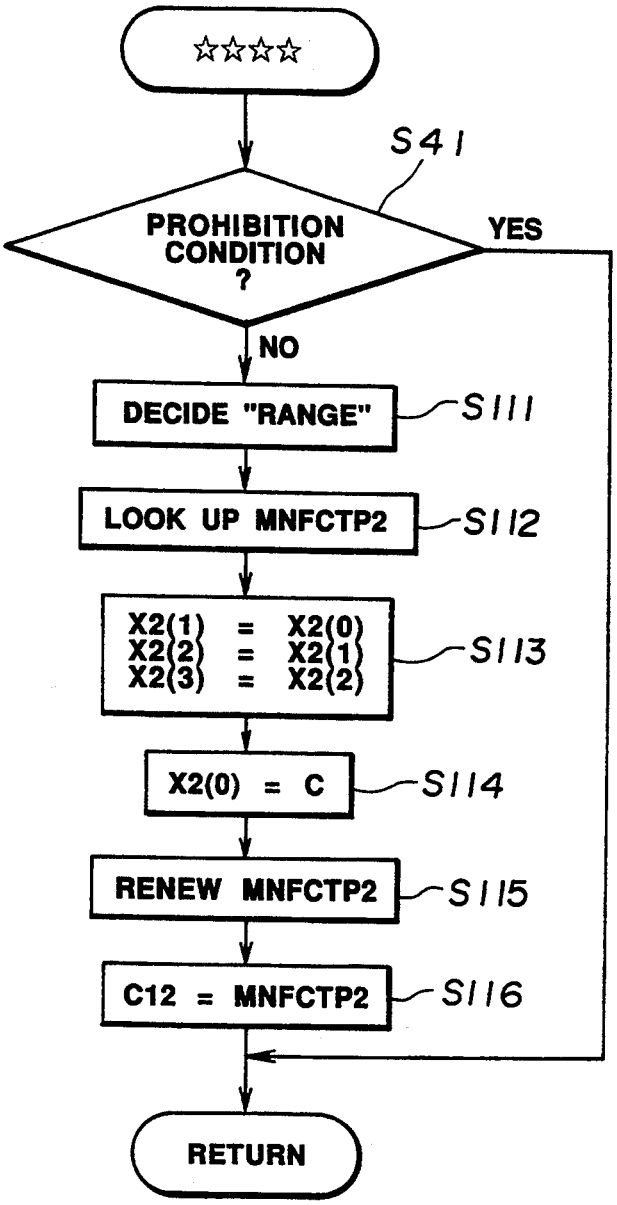
FIG. 17 is a flowchart illustrating the calculation of a moving average MNFCTP2 to be used in the control of the third embodiment air-fuel ratio control system.
Figure 18:
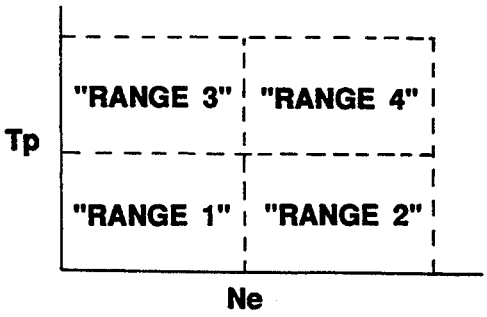
FIG. 18 is a graph showing divided engine operating ranges to be used in the control of the third embodiment air-fuel ratio control system.

FIGS. 15 to 17 illustrates a third embodiment of the air-fuel ratio control system according to the present invention, which is similar to the first embodiment with the exception that engine operating conditions are divided into a plurality of engine operating ranges each of which requires the memories for storing the lapsed engine revolution number (required between the air-fuel ratio inversions), and the moving average and the decision standard renewed with the stored value in the memories. More specifically, the engine operating conditions are divided into four engine operating ranges ("RANGE 1 to RANGE 4") in accordance with the basic fuel injection pulse width Tp and engine speed Ne as shown in FIG. 18.

Assuming that the present engine operating condition falls in RANGE 2, the newest value of the lapsed engine revolution number is fetched to the memory X2(0) corresponding to RANGE 2, and the oldest value of the same is discarded from the memory X2(3). By using these stored values in the memories, the value of the moving average MNFCTP2 is renewed according to the following equation:

$$MNFCTP2=(X2(0)+X2(1)+X2(2)+X2(3))/4 \quad \text{Eq. 8}$$

The thus renewed value is applied as the decision standard C12 in RANGE 2 as indicated at steps S111 to S116 in FIG. 17.

If the engine operating condition shifts to fall in RANGE 3 in FIG. 18 when the integrated amount is applied, the decision standard C13 (=MNFCTP3) for RANGE 3 is read out and compared with the counted value C as indicated at steps S101 to S103 in FIG. 16.

The lapsed engine revolution number required between the air-fuel ratio inversions (each between the rich and lean sides) is largely affected by the engine speed Ne, so that it is relatively small when the flow speed of exhaust gas is high while relatively large when the same flow speed is low. Additionally, the lapsed engine revolution number changes with engine loads. Under such situations, the third embodiment is intended to provide precisely the decision standards respectively to the respective engine operating ranges.

Figure 19:
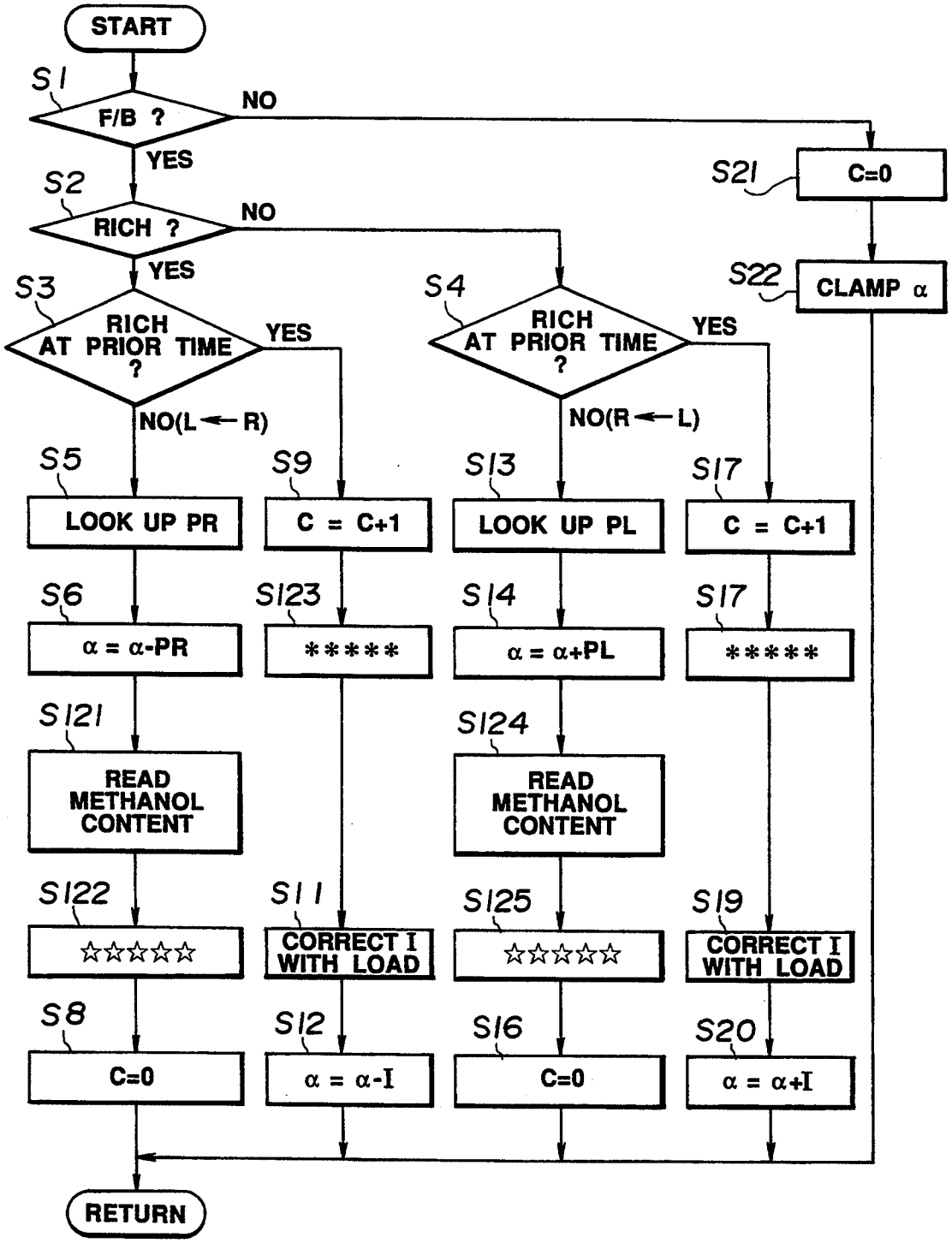
FIG. 19 is a flowchart similar to that of FIG. 15 but showing the calculation of an air-fuel ratio feedback control coefficient to be used in the control of a fourth embodiment of the air-fuel ratio control system in accordance with the present invention.
Figure 20:
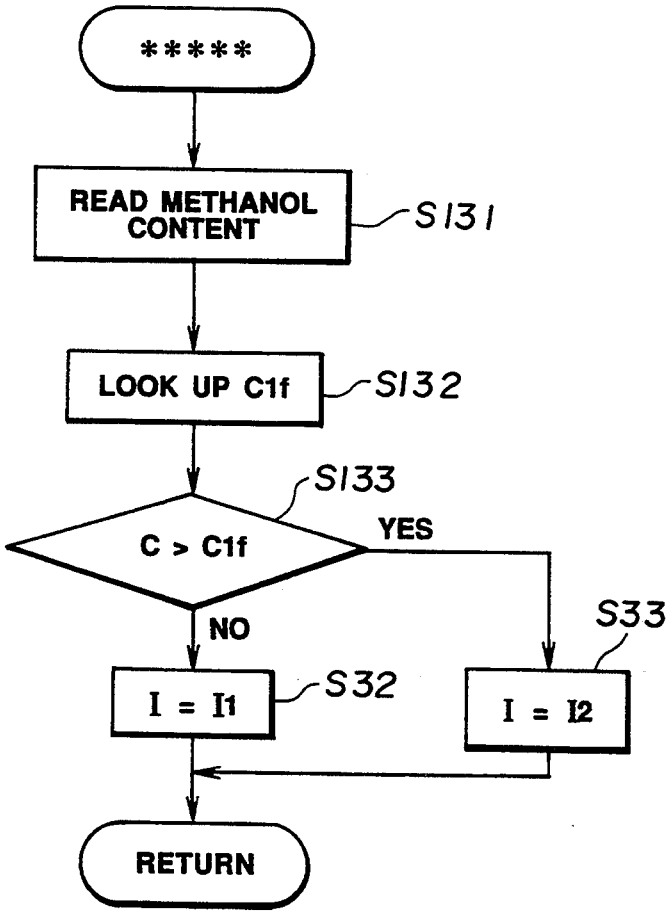
FIG. 20 is a flowchart illustrating the manner of obtaining an integrated amount under look-up, to be used in the control of the fourth embodiment air-fuel ratio control system.
Figure 21:
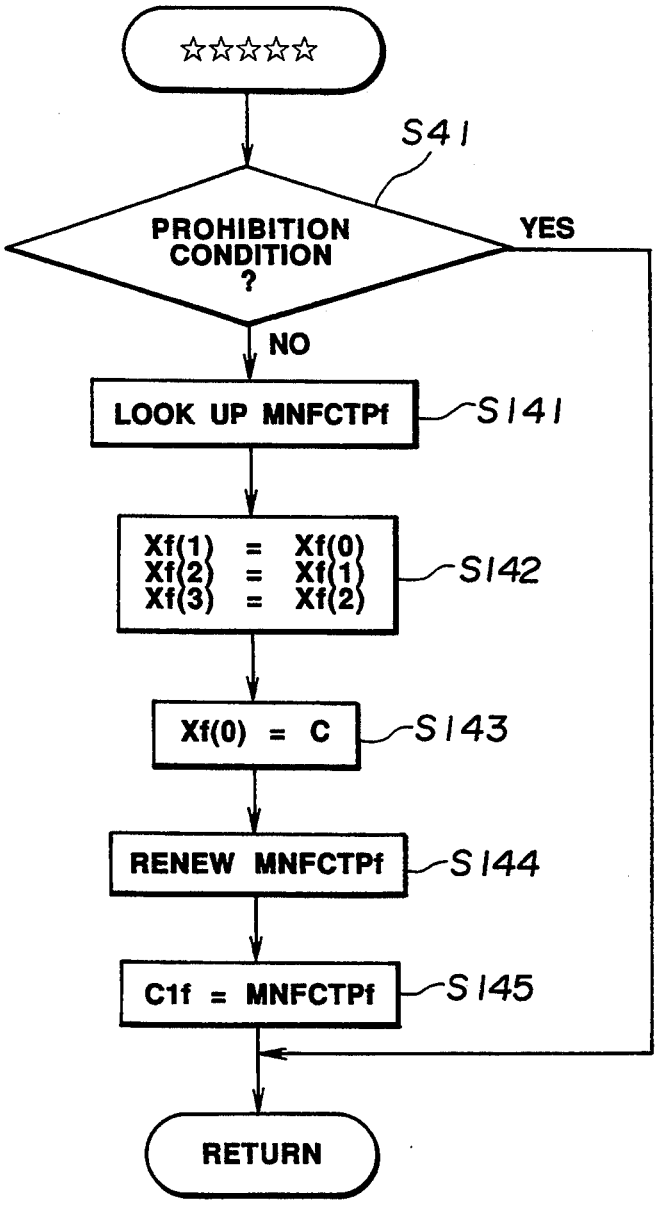
FIG. 21 is a flowchart illustrating the calculation of a moving average MNFCTPf to be used in the control of the fourth embodiment air-fuel ratio control system.

FIGS. 19 to 21 illustrate a fourth embodiment of the air-fuel ratio control system in accordance with the present invention, which is similar to the third embodiment with the exception that the different decision standards are set for respective alcohol content ranges of gasoline-alcohol mixture fuel, for example, in a flexible fuel vehicle using a variety of fuel. Concerning gasoline-alcohol mixture fuel, usually the content of methanol in the mixture fuel is from 0% to 85%. In this embodiment, such mixture fuel is divided to three alcohol content ranges, i.e., a first range of 0 to 30% methanol content, a second range of 30 to 60% methanol content, and third range of 60 to 85% methanol content. The lapsed engine revolution number required between the air-fuel ratio inversions changes in accordance with the content of the methanol in the mixture fuel, and therefore different decision standards are set for the respective ranges.

Assuming that the methanol content in the mixture fuel falls in the first range, the newest value of the lapsed engine revolution number is fetched to the memory Xf(0) corresponding to the first range, and the oldest value of the same is discarded from the memory Xf(3). By using these stored values in the memories, the value of the moving average MNFCTPf is renewed according to the following equation:

$$MNFCTPf=(Xf(0)+Xf(1)+Xf(2)+Xf(3))/4 \qquad \text{Eq. 9}$$

The thus renewed value is applied as the decision standard C1f in the first range as indicated at steps S141 to S145 in FIG. 21.

Thus, according to the fourth embodiment, the decision standard can be provided at a high precision in the flexible fuel vehicle or the like.

Figure 22:
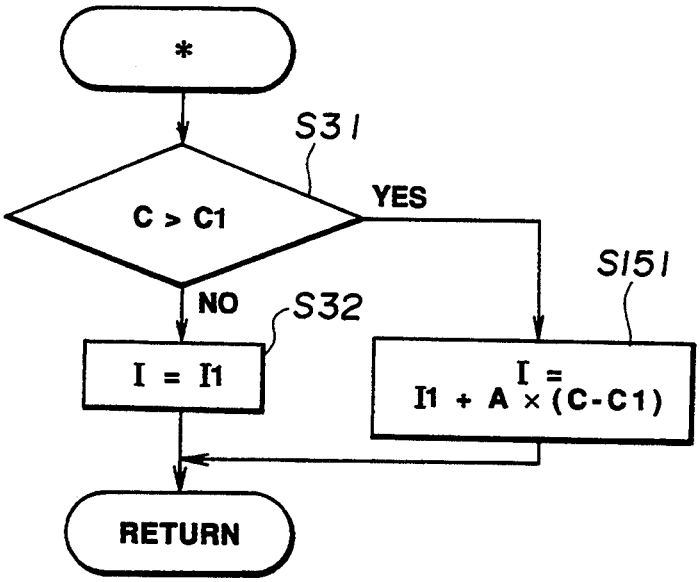
FIG. 22 is a flowchart similar to that of FIG. 4 but showing the manner of obtaining an integrated amount under look-up, to be used in the control of a fifth embodiment of the air-fuel ratio control system in accordance with the present invention.
Figure 23:
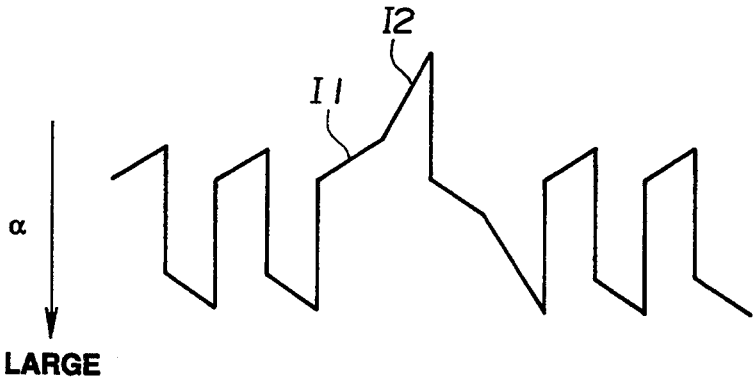
FIG.23 (PRIOR ART)
FIG. 23 is a wave form chart showing a control operation in a conventional air-fuel ratio control system.
Figure 24:
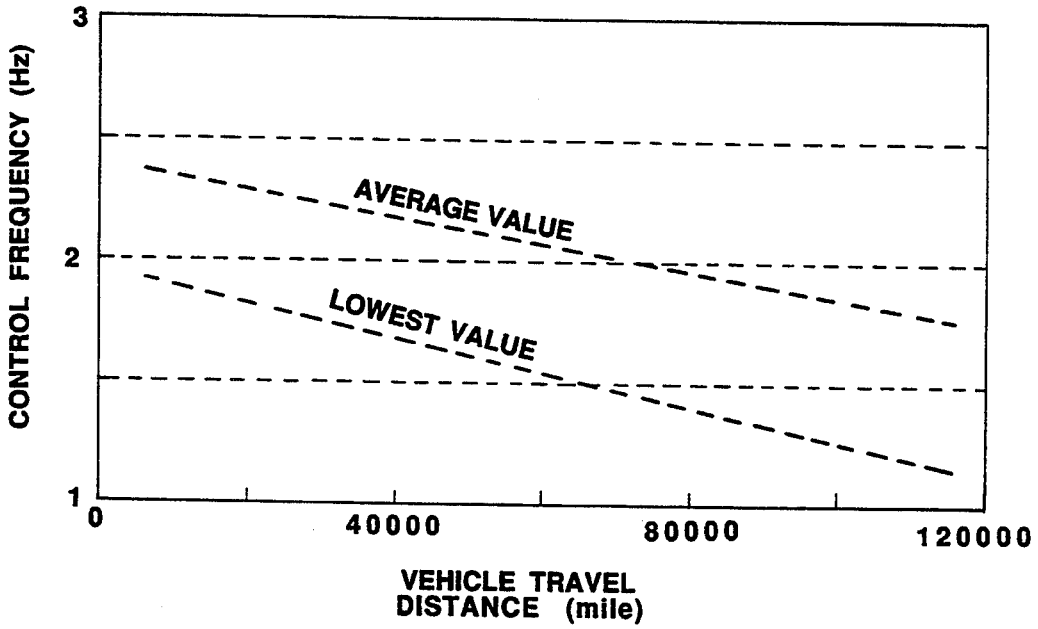
FIG. 24 is a graph showing the control frequency characteristics of an oxygen sensor.

FIG. 22 illustrates a fifth embodiment of the air-fuel ratio control system in accordance with the present invention, same as the first embodiment with the exception that the step S33 in FIG. 8 is replaced with a step S151. It will be understood that the flowchart of FIG. 22 corresponds to that of FIG. 4 of the first embodiment. In this embodiment, after the lapsed engine revolution number exceeds the decision standard C1, the magnitude of the integrated amount I is continuously changed every one engine revolution or every predetermined several engine revolutions as indicated at steps S31, S151 in which "A" represents a constant. It will be appreciated that the air-fuel ratio control system of this embodiment is improved in control precision as compared with the similar system in which the integrated amount is increased stepwise from I1 to I2 with reference to the decision standard C1.

While the calculation of the air-fuel ratio feedback correction coefficient $\alpha$ has been described as being made in timed relation to engine revolution in the above embodiment, it will be understood that the same calculation may be made in timed relation to time, in which a time lapsed between the adjacent inversions of the air-fuel ratio from the lean to rich sides or vice versa may be measured by a counter in place of measuring the above-mentioned lapsed engine revolution number.

What is claimed is:

1. An air-fuel ratio control system for an internal combustion engine, comprising:

an oxygen sensor disposed in an exhaust gas passageway of the engine;

first decision means for deciding whether an air-fuel ratio of air-fuel mixture supplied to the engine is in a rich side or a lean side relative to a stoichiometric value;

second decision means for deciding whether the air-fuel ratio makes its first inversion from the rich side to the lean side or its second inversion from the lean side to the rich side upon taking account of a decision result of said first decision means;

means for measuring a lapsed parameter which has been lapsed between the adjacent first and second inversions of the air-fuel ratio in accordance with decision results of said first and second decision means;

means for comparing a measured value of the lapsed parameter with a decision standard;

means for increasing an integrated amount after the lapsed parameter measured value exceeds the decision standard, relative to that during a time in which the measured value is smaller than the decision standard;

means for calculating an air-fuel ratio feedback correction amount in accordance with the integrated amount;

means for effecting a control of fuel to be supplied to the engine in accordance with the air-fuel ratio feedback correction amount;

a memory for memorizing the lapsed parameter required between the adjacent inversions of the air-fuel ratio;

means for renewing an average value of the lapsed parameter in accordance with the value of lapsed parameter in said memory; and means for setting a value relating to the average value as the decision standard.

2. An air-fuel ratio control system as claimed in claim 1, wherein said memory is arranged to memorize a plurality of the lapsed parameters, wherein said renewing means includes means for renewing a value of a moving average of the lapsed parameter in accordance with values of the lapsed parameters in said memory.

3. An air-fuel ratio control system as claimed in claim 1, further comprising means for disabling said memory and said renewing means from operating so as to prohibit memorizing the lapsed parameter and renewing the average value, under a predetermined engine operating condition.

4. An air-fuel ratio control system as claimed in claim 1, wherein said lapsed parameter measuring means includes first lapsed parameter measuring means for measuring a first lapsed parameter which has been lapsed between the adjacent inversions of the air-fuel ratio in the rich side, and second lapsed parameter measuring means for measuring a second lapsed parameter which has been lapsed between the adjacent inversions of the air-fuel ratio in the lean side; wherein said memory includes first and second memories which respectively memorizing the first and second lapsed parameters; wherein said renewing means includes first renewing means for renewing the average value of the first lapsed parameter in accordance with the value of the first lapsed parameter in said first memory, and means for renewing the average value of the second lapsed parameter in accordance with the second lapsed parameter in said second memory; and wherein said setting means includes first setting means for setting the value relating to the average value of the first lapsed parameter as a first decision standard for the rich side, and second setting means for setting the value relating to the average value of the second lapsed parameter as a second decision standard for the lean side.

5. An air-fuel ratio control system as claimed in claim 1, further comprising means for dividing engine operating conditions into a plurality of engine operating ranges; wherein said memory includes a plurality of memories each memorizing the lapsed parameter for one of the engine operating ranges; wherein said renewing means is arranged to renew the average values of the lapsed parameters respectively in accordance with the values of the lapsed parameters in said memories to obtain a plurality of separate renewed average values which respectively correspond to the engine operating ranges; wherein said setting means is arranged to set the values relating to the average values respectively as the decision standards which respectively correspond to the engine operating ranges.

6. An air-fuel ratio control system as claimed in claim 1, further comprising means for dividing fuel characters into a plurality of kinds in accordance with alcohol content in a mixture fuel; wherein said memory includes a plurality of memories each memorizing the lapsed parameter for one of the fuel character kinds; wherein said renewing means is arranged to renew the average values of the lapsed parameters respectively in accordance with the values of the lapsed parameters in said memories to obtain a plurality of separate renewed average values which respectively correspond to the fuel character kinds; wherein said setting means is arranged to set the values relating to the average values respectively as the decision standards which respectively correspond to the fuel character kinds.

7. An air-fuel ratio control system as claimed in claim 1, wherein said integrated amount increasing means includes means for continuously increasing the integrated amount after the lapsed parameter measured value exceeds the decision standard.

* * * * *